United States Patent [19]

Kranzler

[11] 4,253,244

[45] Mar. 3, 1981

[54] ELECTRONIC CONTROL SYSTEM FOR LOW TEMPERATURE GRAIN DRYING

[75] Inventor: Glenn A. Kranzler, Pullman, Wash.

[73] Assignee: Iowa State University Research Foundation, Inc., Ames, Iowa

[21] Appl. No.: 51,411

[22] Filed: Jun. 25, 1979

[51] Int. Cl.[3] ..... F26B 21/10; F26B 21/12

[52] U.S. Cl. ..... 34/48; 34/54; 34/233

[58] Field of Search ..... 34/46, 48, 50, 44, 54, 34/92, 233; 98/55

[56] References Cited

U.S. PATENT DOCUMENTS

| | | | |
|---|---|---|---|
| 3,217,424 | 11/1965 | Johnson et al. | 34/48 |
| 3,470,626 | 10/1969 | Pfeiffer | 34/46 |
| 3,563,460 | 2/1971 | Nine | 34/54 |
| 3,979,838 | 9/1976 | Tonn | 34/93 |
| 4,053,991 | 10/1977 | Steffen | 34/545 |
| 4,148,147 | 4/1979 | Steffen . | |

*Primary Examiner*—Larry I. Schwartz

*Attorney, Agent, or Firm*—Emrich, Root, Lee, Brown & Hill

[57] ABSTRACT

A low-temperature grain drying/aeration system includes a controller having an initialization circuit which is programmed on the basis of long term computer simulation of the low-temperature drying process to respond to inputs representing initial conditions such as harvest date, harvest moisture and air flow rate, and control a dry down indicator to indicate the probability of drying success and the time of completion of the drying. The controller responds to control outputs provided by the initialization circuit to provide humidistatic control of fan and heater operation during the drying operation, and to permit heater operation only when supplemental heat is desirable. At the end of the normal drying season, the controller automatically transfers operation from the drying mode to an aeration mode to provide periodic ventilation of the stored grain, and effects shut down of the system when conditioning of the grain is completed. In one embodiment, the supplemental heat is derived from a solar heating system, and an electrical resistance heater is provided as a back-up energy source during prolonged periods of low solar collector output.

43 Claims, 18 Drawing Figures

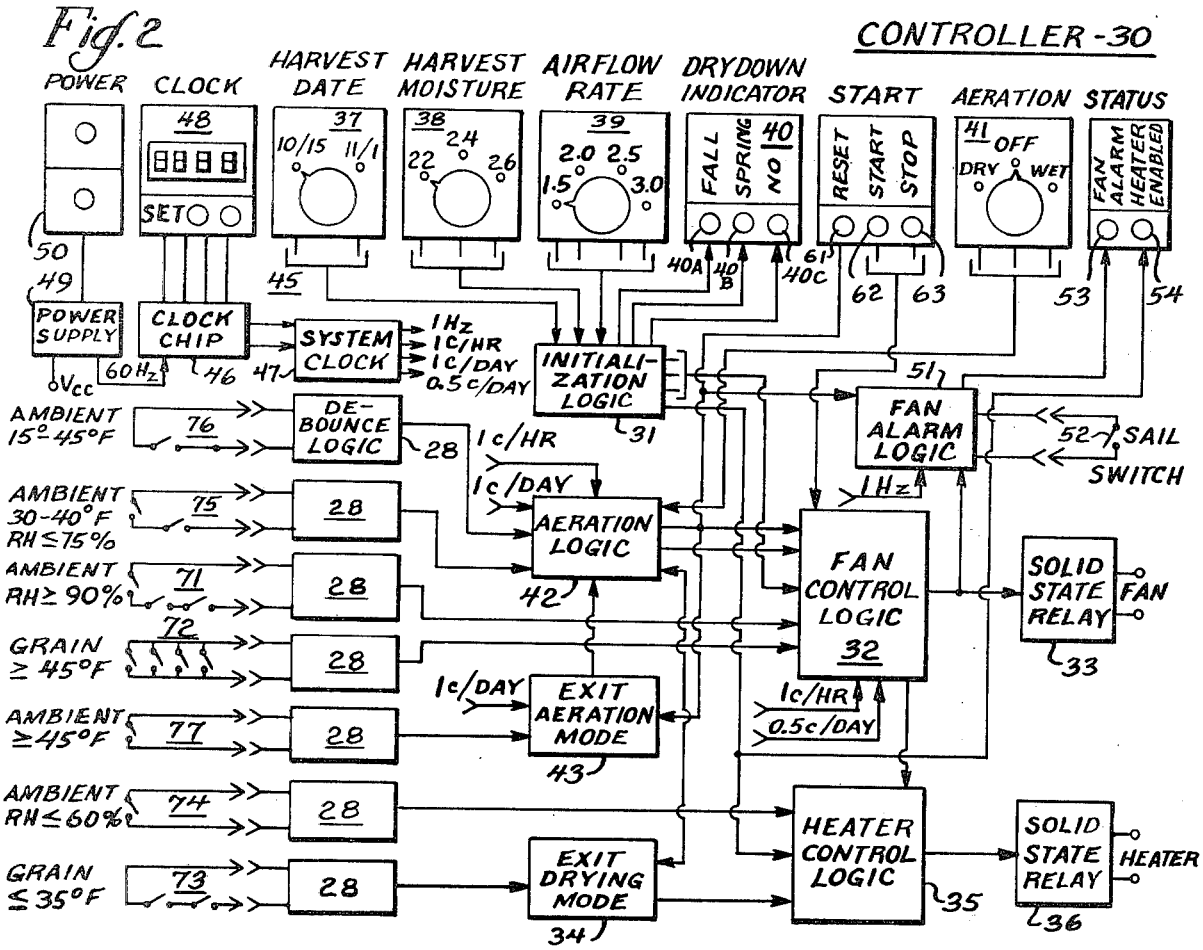
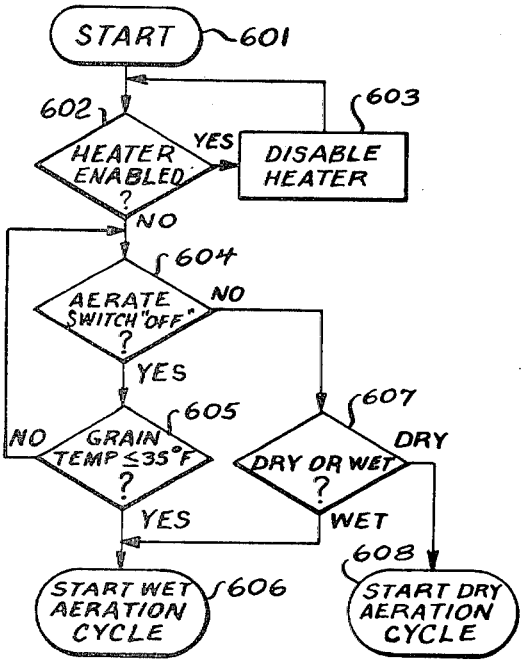
Fig. 6
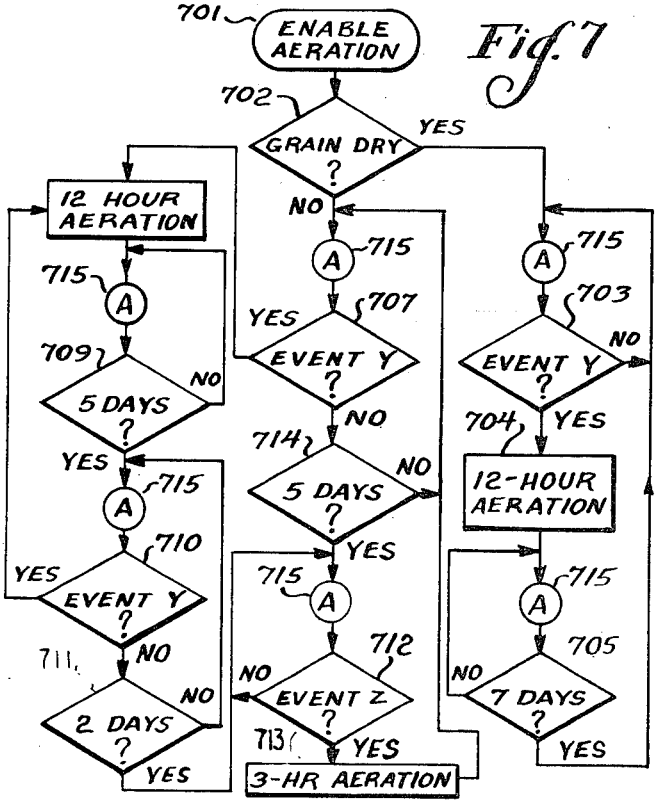

FAN ALARM LOGIC-51

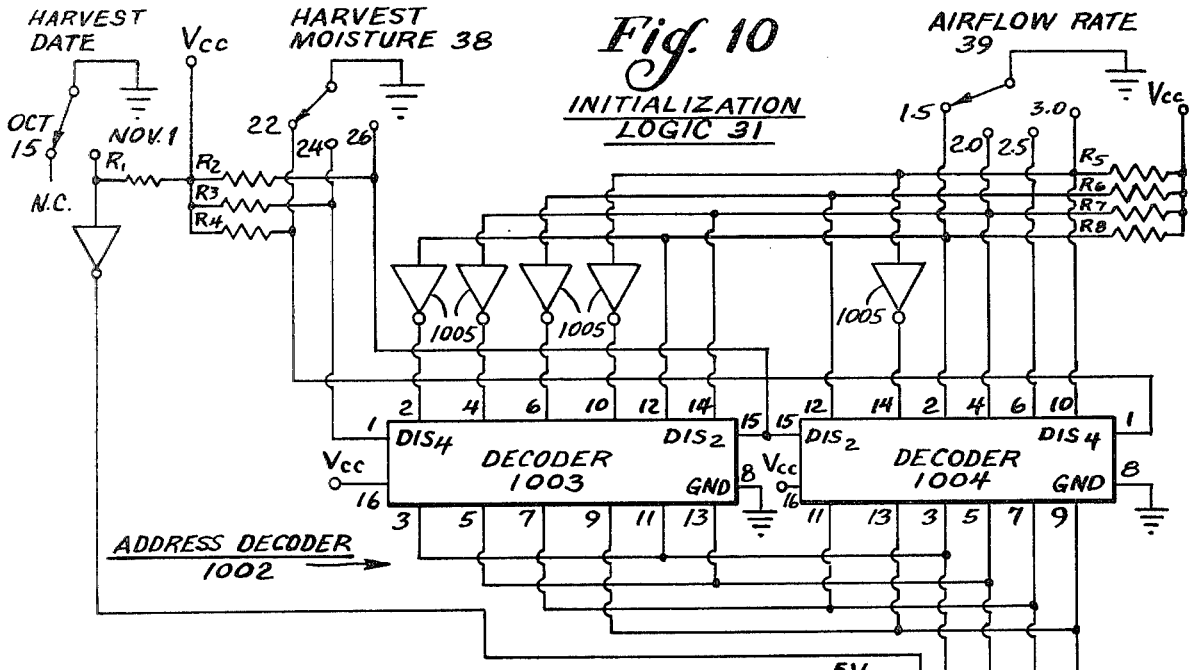
HARVEST DATE
Vcc
HARVEST MOISTURE 38
Fig. 10
INITIALIZATION LOGIC 31
AIRFLOW RATE 39
OCT 15
NOV. 1
N.C.
R1
R2
R3
R4
R5
R6
R7
R8
1.5
2.0
2.5
3.0
22
24
26
1005
DIS4
DIS2
DECODER 1003
DECODER 1004
GND
ADDRESS DECODER 1002

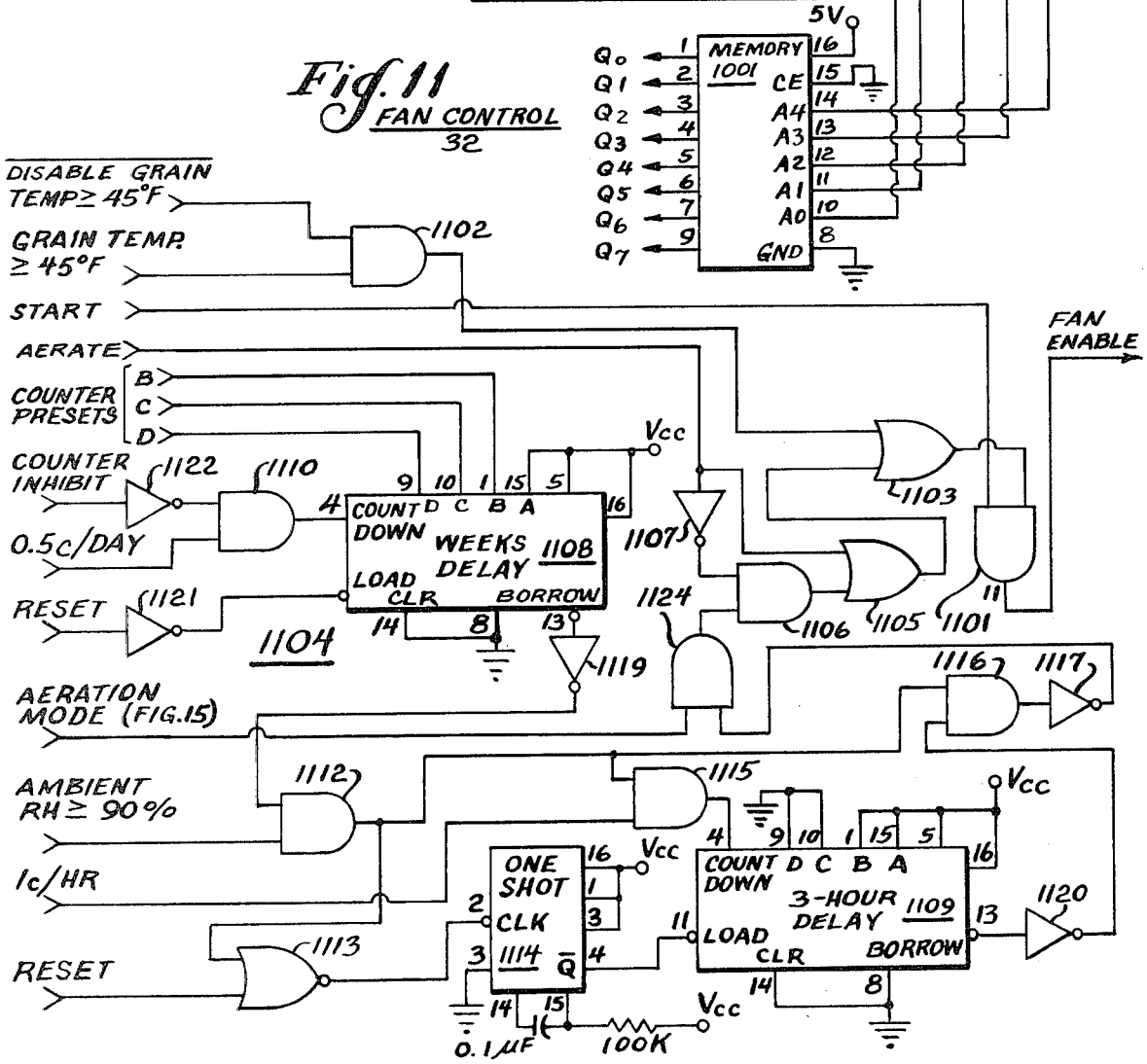
Fig. 11
FAN CONTROL 32
5V
MEMORY 1001
CE
A4
A3
A2
A1
A0
GND
Q0
Q1
Q2
Q3
Q4
Q5
Q6
Q7
DISABLE GRAIN TEMP ≥ 45°F
GRAIN TEMP. ≥ 45°F
START
AERATE
COUNTER PRESETS
B
C
D
COUNTER INHIBIT
0.5c/DAY
RESET
AERATION MODE (FIG.15)
AMBIENT RH ≥ 90%
1c/HR
RESET
FAN ENABLE
COUNT DOWN
WEEKS DELAY 1108
LOAD
CLR
BORROW
1104
ONE SHOT
CLK
1114
Q
COUNT DOWN
3-HOUR DELAY 1109
0.1μF
100K
1101
1102
1103
1105
1106
1107
1110
1112
1113
1115
1116
1117
1119
1120
1121
1122
1124

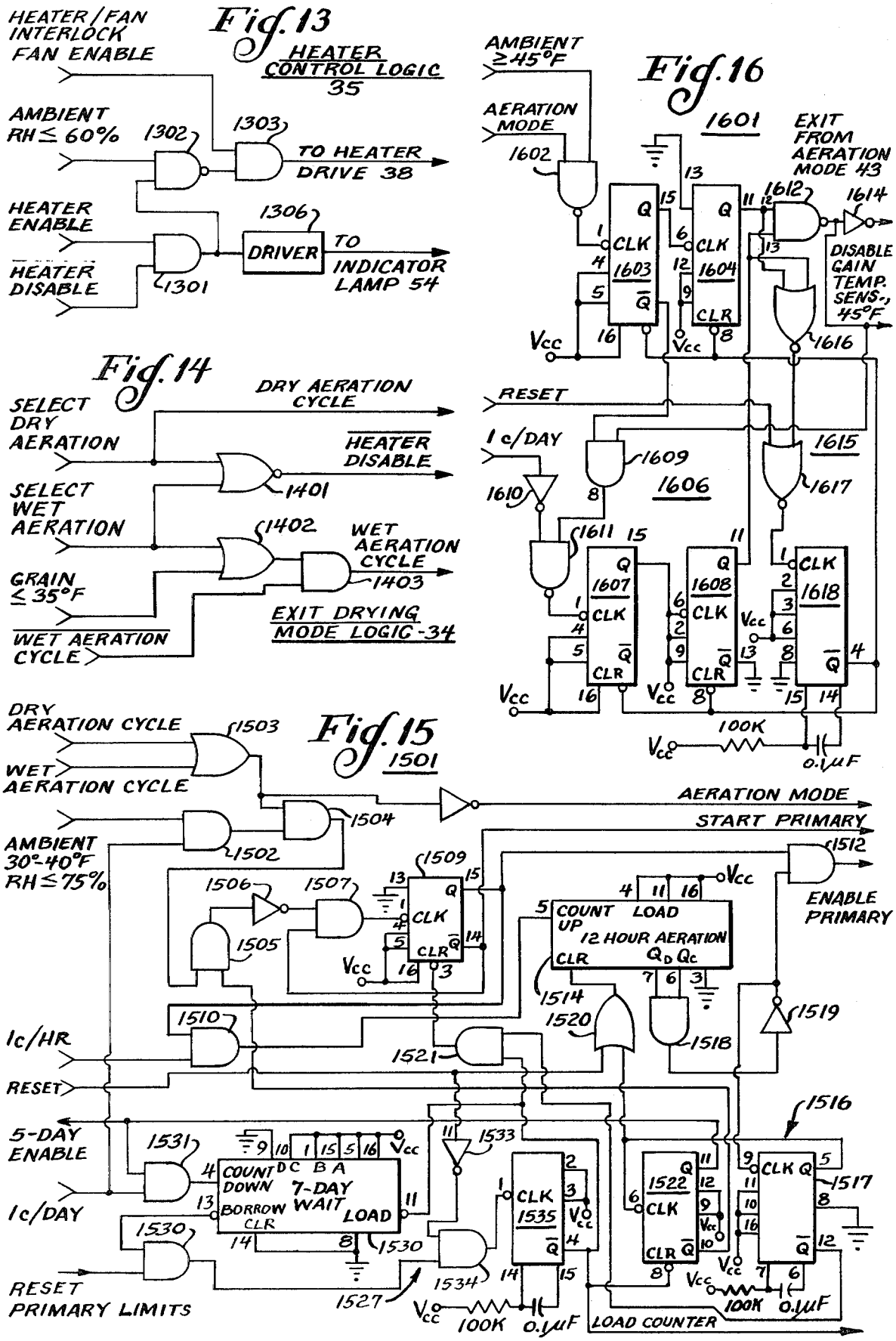
Fig. 13
HEATER CONTROL LOGIC 35
HEATER/FAN INTERLOCK FAN ENABLE
AMBIENT RH ≤ 60%
HEATER ENABLE
HEATER DISABLE
1302
1303
1306
1301
DRIVER
TO HEATER DRIVE 38
TO INDICATOR LAMP 54
Fig. 14
SELECT DRY AERATION
SELECT WET AERATION
GRAIN ≤ 35°F
WET AERATION CYCLE
DRY AERATION CYCLE
HEATER DISABLE
1401
1402
WET AERATION CYCLE
1403
EXIT DRYING MODE LOGIC-34
Fig. 16
1601
AMBIENT ≥45°F
AERATION MODE
1602
1603
1604
EXIT FROM AERATION MODE 43
1612
1614
DISABLE GAIN TEMP. SENS., 45°F
1616
RESET
1 c/DAY
1610
1609
1606
1611
1607
1608
1615
1617
1618
Vcc
100K
0.1μF
Fig. 15
1501
DRY AERATION CYCLE
WET AERATION CYCLE
1503
1504
AERATION MODE
START PRIMARY
AMBIENT 30°-40°F RH ≤ 75%
1502
1505
1506
1507
1509
1512
ENABLE PRIMARY
COUNT UP
LOAD
12 HOUR AERATION
CLR
1514
1520
1518
1519
1510
1521
1c/HR
RESET
5-DAY ENABLE
1531
COUNT DOWN
7-DAY WAIT
BORROW
LOAD
1533
1535
1522
1516
1517
1c/DAY
1530
RESET PRIMARY LIMITS
1527
1534
LOAD COUNTER

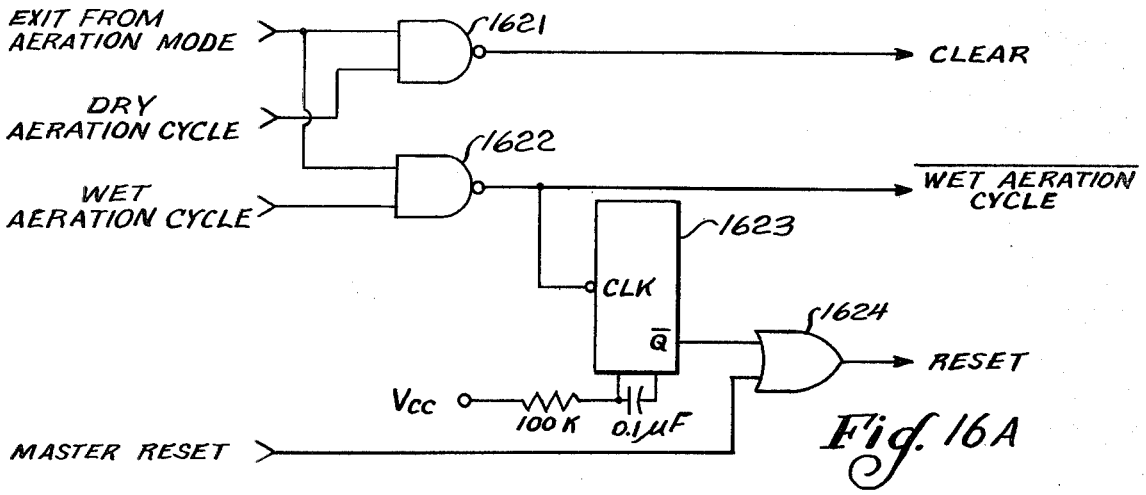
Fig. 16A
Fig. 17
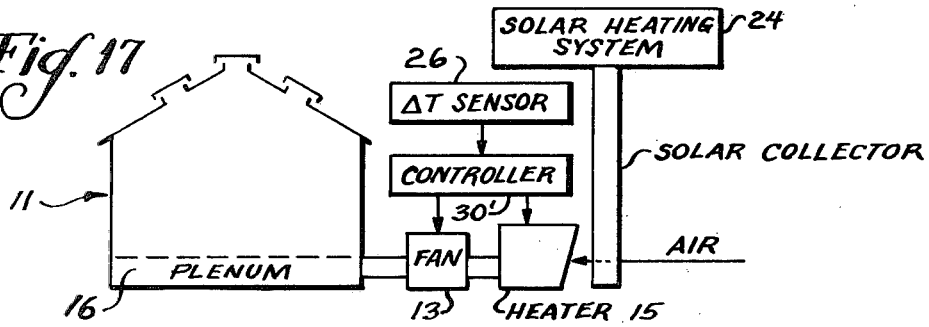
Fig. 18
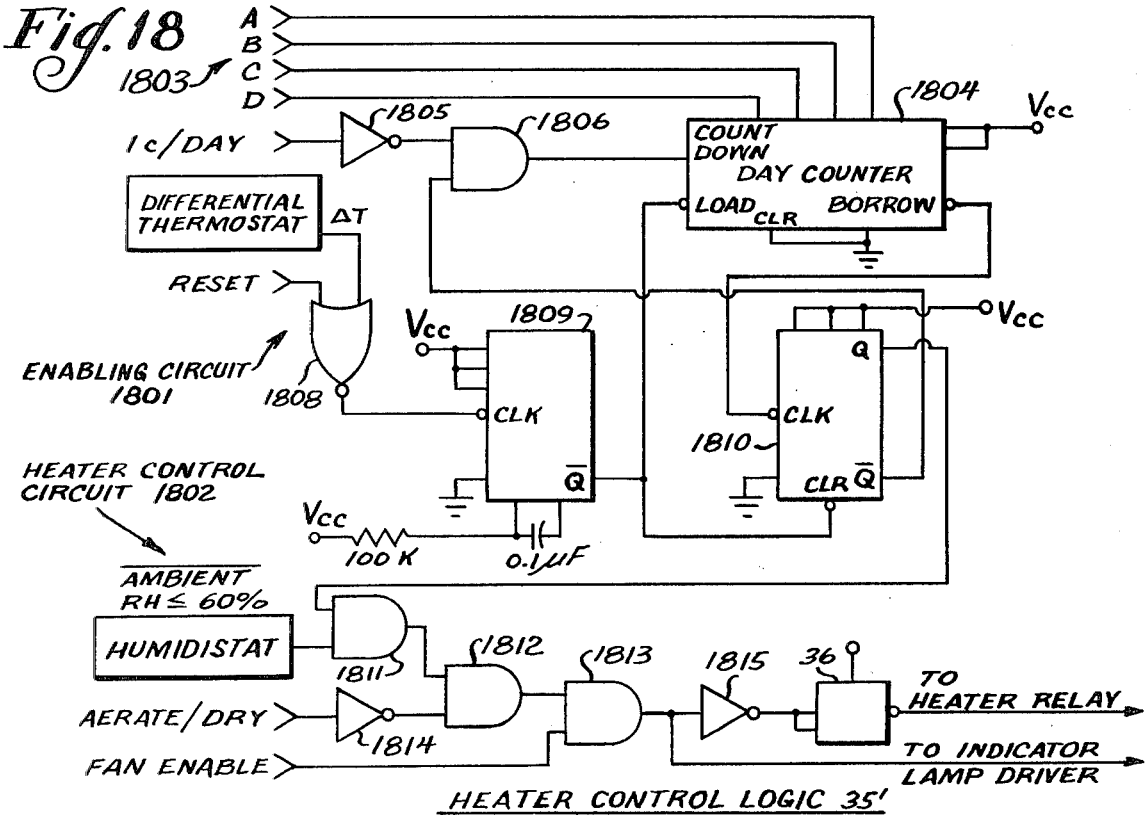

ELECTRONIC CONTROL SYSTEM FOR LOW TEMPERATURE GRAIN DRYING

BACKGROUND OF THE INVENTION

1. Field of the Invention

This invention relates to grain drying systems, and particularly to a method and apparatus for controlling low-temperature drying of grain.

2. Description of the Prior Art

Interest in low-temperature grain drying has grown in recent years, partly because of the increasing expense and uncertainty of fuel supplies required for conventional high-temperature continuous-flow dryers. Other factors favoring the low-temperature approach to grain drying include simpler equipment requirements, more efficient use of energy inputs, and higher quality of the conditioned product.

Low-temperature grain drying is similar in concept to drying with natural air. The grain to be dried is stored in a drying/storage bin equipped with a false floor of perpherated metal to permit the passage of air. Ambient air, drawn into the storage bin by way of a fan, is forced up through the wet grain column and passes out of the storage bin through roof vents. As the air passes through the grain, moisture is evaporated from the grain and carried out of the bin. The incoming ambient air provides the primary energy source for removing the moisture from the grain. Generally, low-temperature drying systems include a heater for heating the ambient air a few degrees above ambient to raise the drying capacity of the air.

Low-temperature grain drying is designed for late-fall grain conditioning when low average daily air temperatures restrict mold growth in the slowly drying product. The grain is normally stored in the drying bin and held for spring sale. While the low fall air temperatures restrict spoilage arising from mold growth in the slowly drying product, low-temperature drying depends heavily on the energy in the ambient air for the heat of vaporization required to remove moisture from the grain. Because of the limited capacity of cool air to absorb moisture, the drying process is slow and weather-dependent. For example, operation of the drying fan during periods of high ambient relative humidity adds moisture to the grain already dried. Ventilation of the grain with ambient air at temperatures below 30° F. may result in aggregate freezing of the grain. Operation of the heater during periods of low relative humidity may result in overdrying. Limits on safe storage time, which are governed largely by grain moisture content and temperature, impose restrictions on system operation, and skillful management is required to dry the grain before it spoils.

The use of aeration to maintain the condition of dried or partially dried grain stored over the winter months is accepted practice. The process consists of ventilating the grain with ambient air to limit moisture migration by minimizing temperature gradients and to inhibit mold growth and insect activity by maintaining a low storage temperature. In low-temperature drying systems, aeration is normally accomplished by periodic operation of the drying fan.

During unventilated storage, grain temperatures near the bin wall tend to follow average ambient levels. Temperature gradients develop between the perimeter grain and the grain closer to the center. Convection air currents slowly redistribute moisture from the warmer to the cooler areas. If allowed to continue, this "moisture migration" produces wet-grain zones with high susceptibility to spoilage. Aeration equalizes temperatures within the grain mass and minimizes moisture migration.

Biological activity in stored grain is directly related to grain temperature. Below 50° F., the development of microflora within the grain is restricted significantly. The risk of damage from molds, as well as from stored-grain insects, is reduced greatly by using aeration to maintain low temperatures throughout the bulk. Aeration also serves to remove heat generated by the respiring grain and microorganisms.

While prevailing weather conditions are a major condition in the success of a low-temperature grain drying operation, other influencing factors include the rate of air flow through the storage bin, the grain harvest date, the initial moisture content of the grain at the harvest date, and the temperature of the grain. These variables determine the time required to dry the grain to a given moisture content and the amount of deterioration of grain during the drying period.

Past results have shown that manual operation of the fan and heater based upon general guide lines insures neither optimum drying or conditioning of the grain nor efficient use of energy inputs. As a step in the the analysis of low-temperature grain drying systems, computer models have been designed to simulate the low-temperature drying process. One such computer model is described in an article by P. D. Bloome and G. C. Shore, entitled "Simulation of Low-Temperature Drying of Shelled Corn Leading to Optimization", which appeared in the *Transactions of the American Society of Agricultural Engineers,* Vol. 15, No. 2, pages 255–265. The computer model was used to simulate the performance of low-temperature drying systems using weather data as an input. Cumulative probability curves were developed to predict successful drying as a function of air flow rate with up to 5° F. of sensible heat added to the input air.

A mathematical model designed to simulate the performance of a temperature-controlled shelled corn storage system was developed and verified experimentally by T. L. Thompson. The model is described in an article entitled "Temporary Storage of Moist Shelled Corn Using Continuous Aeration" which appeared in the *Transactions of the American Society of Agricultural Engineers,* Vol. 15, No. 2, pages 333–337. The model was used to simulate the effects of air flow rate, harvest date, initial moisture content, grain temperature, and weather conditions on storage deterioration.

Although extensive work has been done on the computer simulation of low-temperature drying processes, very little attention has been directed to actual controls for natural-air and low-temperature drying systems, or to the development of control systems for use in on-site applications.

In one study of natural-air drying of wheat and shelled corn, the effectiveness of continuous ventilation was compared with that of intermittent ventilation under humidistatic control. The intermittent fan was operated only when the relative humidity of the air was below 85 percent. Fan control methods evaluated included continuous operation of the fan; thermostat control, limiting operation to temperatures of 40° F. and below; photocell control, limiting operation to night-time hours; and manual control, at the discretion of the owner-operator. Another low-temperature drying system employed continuous ventilation and time clock-heater control in which a time clock was programmed to turn off the heater during the hours showing a predicted equilibrium moisture content below a target level.

The development of the control methods referred to above was basically empirical in nature and none of the proposed methods has been entirely satisfactory either because of the need for a considerable amount of operator intervention or because the control method used simply did not result in good conditioning and/or was characterized by inefficient use of energy. Thus, it is apparent that controls to assist management, when present, are limited in scope and effect. A need exists for more comprehensive controls capable of increasing efficiency and reducing management requirements. Such controls are not currently available.

SUMMARY OF THE INVENTION

The present invention provides a method and control apparatus for low-temperature grain drying systems which (a) reduce the risk of unsuccessful drying due to spoilage by identifying combinations of starting conditions with a high probability of success; (b) increase efficiency of drying by reducing the consumption of electrical energy; and (c) reduce management requirements through the use of automatic control during drying and aeration cycles.

The system includes a controller which receives input signals representing initial conditions, and sensed conditions, such as ambient temperature, ambient relative humidity and grain temperature, and uses the received signals to generate control outputs based upon grain moisture levels predicted through computer simulation of the low temperature grain drying process, such as by the use of a resident model of the drying process or suitable logic preprogrammed on the basis of the long term simulation of the drying process. The controller defines drying aeration cycles provides intermittent fan operation in drying the grain to an average moisture content of a selected value.

In an exemplary embodiment, the system includes a controller having initialization logic which is preprogrammed on the basis of long term simulation of the low-temperature drying process to respond to inputs, or initial conditions, indicative of harvest date, harvest moisture, and air flow rate and control a dry down indicator. The dry down indicator indicates whether or not there is a 90% probability of drying success for the initial conditions, which are supplied to the controller over selector switches set by the operator, and identifies combinations of initial conditions with a probability success thereby reducing the risk of unsuccessful drying. The operator is alerted to the unsuccessful combinations of initial conditions and can select different "successful" settings. The operator may, before the grain is loaded into the grain drying/storage bin, select an air flow rate while controlling fill depth so as to obtain successful drying. For successful combinations, the dry down indicator also shows whether completion of drying can be expected in fall or in spring.

The initialization logic also enables fan control logic, after a preprogrammed delay established by the initialization logic, to respond to a humidistat and halt fan operation during prolonged periods of high relative humidity to minimize rewetting of partially dried grain. The initialization logic also automatically enables heater control logic, or maintains it disabled, in accordance with its programming to provide supplemental only when necessary to assure spring completion of drying of the grain, or if the supplemental heat will result in fall completion of grain drying. In one embodiment, a solar heat source provides the supplement heat and an electrical resistance heater serves as a back-up energy source during prolonged periods of low solar collector output. In another embodiment, an electrical resistance heater serves as the primary heat source. Heater operation is humidistatically controlled to prevent overdrying of the grain. The automatic control of both fan and heater during drying, and of fan operation during aeration increase the efficiency of drying by reducing power consumption.

The controller also includes aeration logic which is enabled at the end of the fall grain drying season and effects periodic ventilation of the grain to maintain the condition of the dried or partially dried grain while the grain is stored over winter months. The aeration logic provides separate aeration modes for dry grain and for partially dried grain. In the dry grain mode, a primary twelve hour aeration is initiated by the aeration logic upon occurrence of primary aeration conditions namely ambient temperature in the range of 30°–40° F., and relative humidity less than or equal to 75%. The initiation of a primary aeration is limited to afternoon or evening hours. Following a primary aeration, the aeration logic provides a seven day delay period before further aerations are enabled.

For wet grain aeration cycles, primary aerations are supplemented by secondary or three hour aerations which are initiated under relaxed ambient restrictions. Following a primary aeration, the aeration logic prevents a further aeration for a period of five days after which a primary aeration cycle is enabled upon the occurrence of conditions within the primary aeration limits. In the absence of the primary aeration conditions within two days of the five day wait period, secondary aeration limits are enabled, and a secondary or three hour aeration is initiated upon the occurrence of conditions within the secondary aeration limits, which are ambient temperature in the range of 15°–45° F. Following a secondary aeration, primary aeration limits are enabled, and in the absence of primary aeration conditions within five days of the secondary aeration, the secondary aeration limits are reenabled.

The periodic ventilation of the stored grain with outside air reduces the risk of deterioration resulting from biological activity and moisture migration. The criteria for initiating a primary aeration are selected to minimize rewetting and to maintain the grain moisture content near a desired level. The secondary aerations, provided by the aeration logic for wet grain aeration cycles, minimize the spoilage danger by cooling and equalizing grain temperatures.

Automatic control of fan and heater during drying operation, and of the fan during aeration cycles, minimizes management requirements. In addition, the controller includes exit drying mode logic which provides automatic transfer of the controller operation from the drying mode to the aeration mode when the temperature of the grain decreases to 35° F., and exit aeration mode logic which shuts down the system for fall dried grain or transfers controller operation from the aeration mode to the drying mode for partially dried grain. However, manual override is provided to enable the operator to transfer controller operation from the drying mode to the aeration mode when the grain has been dried to a desired condition, and to shut down the system when conditioning of the grain is completed.

DESCRIPTION OF THE DRAWINGS

FIG. 2 is a block diagram of a controller employed in the system shown in FIG. 1;

FIG. 6 is a flow diagram illustrating exit from drying;

FIGS. 7 and 7A are flow diagrams illustrating the aeration mode, including dry grain aeration cycles and wet grain aeration cycles;

FIG. 10 is a schematic circuit diagram for initialization logic of the controller;

FIG. 11 is a schematic circuit diagram for fan control logic of the controller;

FIG. 13 is a schematic circuit diagram of heater control logic of the controller;

FIG. 14 is a schematic circuit diagram of exit from drying mode logic of the controller;

FIGS. 14 and 15A are schematic circuit diagrams of primary and secondary aeration circuits, respectively, of the aeration mode logic of the controller;

FIGS. 16 and 16A are a schematic circuit diagram of exit from aeration mode logic of the controller, FIG. 17 is a simplified representation of a low-temperature grain drying/aeration system employing solar heating; and FIG. 18 is a schematic circuit diagram of a heater control logic of a controller employed in the system shown in FIG. 17.

DESCRIPTION OF PREFERRED EMBODIMENTS

Figure 1:
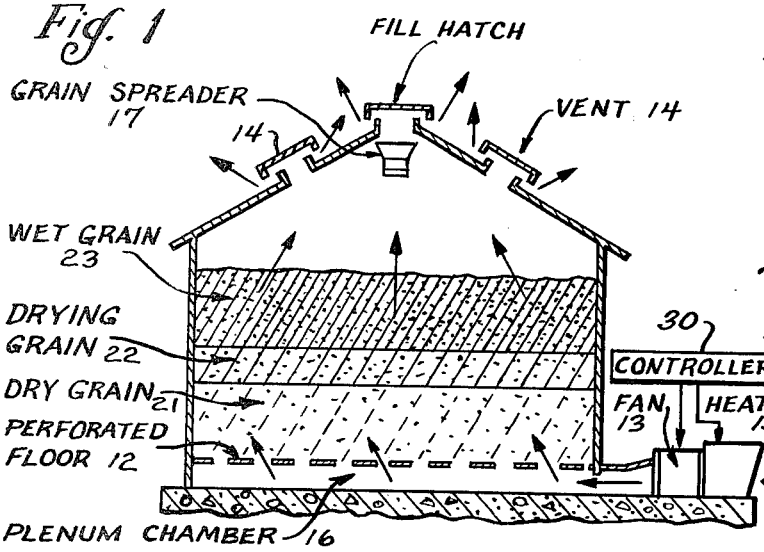
FIG. 1 is a simplified representation of a low-temperature grain drying/aeration system incorporating the principles of the present invention.

Referring to the drawings, FIG. 1 is a simplified representation of a low-temperature grain drying system including a grain storage bin 11, a fan 13 and a heater 15 as used in conventional systems, and a controller 30, provided by the present invention, which controls the operation of the fan 13 and the heater 14.

The harvested grain is stored in the cylindrical metal drying/storage bin 11 which is equipped with false floor 12 of perforated metal to permit the passage of air. During drying and aeration cycles, ambient air is drawn into the storage bin by the fan 13 and forced into a plenum chamber 16 beneath the floor and up through the floor and the wet grain column and passes out of the bin through roof vents 14. As the air passes through the grain column, moisture is evaporated from the grain and carried out of the bin. In order to facilitate uniform upward air flow, an electric grain spreader 17 is used to provide even distribution of the grain during filling of the bin. The heater 15 is provided to heat the ambient air supplied to the inlet of the fan during the drying operation.

The storage bin 11 is assumed to have a diameter of 21 feet and a capacity at 16 foot depth of approximately 4400 bushels. A 7.5-HP vane axial fan is employed to provide a minimum air flow rate of 1.5 cfm per bu for a filling depth is 16 feet (4400 bu.). Air flow rate is controlled by varying the depth of fill, and the depth of grain required to obtain desired air flow rates of 2, 2.5 and 3 cfm/bu 13 ft. (3850 bu), 11 ft. (3025 bu), 10 ft. (2759 bu), respectively.

The fan 13 imparts a temperature rise of approximately 2° F. to the air as it passes through the fan. The heater 15, which in the exemplary embodiment is an electrical resistance heater having a capacity of 6.8 KW, provides an additional temperature rise of approximately 3° F. resulting in an overall temperature rise of 5° F. when the heater is enabled. As will be described hereinafter, a solar heating system may be used in place of the electrical resistance heater.

CONTROLLER

The system is basically a manual closed loop control system with minimum operator participation. Referring to the block diagram of the controller 30 shown in FIG. 2, the controller includes selector switches 37–39 which the operator sets to supply information representing harvest date, harvest moisture, and air flow rate to the controller 30. The controller includes initialization logic 31 which responds to these inputs to provide an indication via a dry down indicator 40 of whether the combination of input variables will result in a successful or unsuccessful drying operation. The dry down indicator 40 also indicates whether drying of the grain will be completed in fall or spring.

Condition sensors, indicated generally at 29, provide control outputs representative of ambient relative humidity, ambient temperature, and grain temperature for other circuits of the controller 30 which include fan control logic 32 heater control logic 35 exit drying mode logic 34, aeration logic 42 and exit aeration logic 43. The conditions sensed by the sensors 29 and the placement of these sensors is described hereinafter.

The fan control logic 32 and the heater control logic 35 respond to sensors 29 to provide humidistatic control of the fan 13 and the heater 15 during the drying cycle and intermittent operation of the fan during aeration cycles.

During drying operation, the operator monitors the condition of the grain and when it is determined that a satisfactory moisture level for the grain has been reached, the operator transfers operation of the controller from the drying mode to the aeration mode. However, the exit drying mode logic 34 automatically transfers from the drying mode to the aeration mode at the end of the drying season when the grain temperature decreases to 35° F. before manual transfer is effected by the operator. The aeration logic 42 provides separate aeration modes for dry grain and for partially dried grain. The two aeration modes are hereinafter referred to as the "dry grain aeration cycle" and the "wet grain aeration cycle". As will be shown, the conditions for initiating a wet grain aeration cycle are selected to enhance the probability of aerations during the storage period following of the drying operation.

The exit aeration mode logic 43 provides automatic exit from the aeration mode at the end of the conditioning period, and shuts down the system for fall dried grain or transfers to the drying mode for partly dried grain stored over the winter for spring completion of drying. Manual override is provided to permit the operator to shut down the system when conditioning of the grain is completed.

Considering the controller 30 in more detail, the harvest date selector switch 37 permits selection of harvest dates of October 15 of November 1. The harvest moisture selector switch 38 permits selection of harvest moisture content of 22, 24 and 26 percent. The air flow rate selector switch 39 permits selection of air flow rates of 1.5, 2, 2.5 and 3 cfm/bu.

The initialization logic 31 is preprogrammed on the basis of long term simulation results of the low-temperature drying process to respond to inputs representing harvest date, harvest moisture and air flow rate to provide control outputs for dry down indicator 40. The initialization logic 31 responds to the inputs indicative of the settings of selector switches 37–39 to provide control outputs to the dry down indicator 40 to indicate whether, the combination of input variables selected result in a 90% or better probability of drying success and if completion of drying can be expected in the fall or the spring. The dry down indicator 40 includes indicator lamps 40A–40C for indicating fall completion of grain drying, spring completion of grain drying and unsuccessful drying cycle, respectively. For a given set of initial values of harvest date, harvest moisture content and air flow rate, the initialization logic 31 causes one of the three indicator lamps 40A–40C to be lit. If the combination of input variables represents an unsuccessful combination, so that indicator 40C is lit, the operator is alerted to the fact that this set of initial conditions will not result in a 90% or better probability of drying success, and the operator is instructed to choose a higher "successful setting". Thus, by dialing in appropriate settings for the known initial settings prior to harvest and before the grain is loaded into the storage bin 11, the operator may plan in advance to appropriate a successful combination and to control the depth of fill to a level which will permit successful drying of the grain i.e., fill depths of 13, 11 or 10 feet for air flow rates of 2, 2.5 and 3 cfm/bu, respectively.

The controller 30 also includes an aeration switch 41 which is normally maintained in an off position and is manually operable to a "dry" position or a "wet" position to enable aeration logic 42 of the controller 30 to transfer from the drying mode to the aeration mode and provide dry grain aeration cycles and wet grain aeration cycles, respectively. Exit aeration mode logic 43 provides automatic exit from the aeration mode when the average daily temperature reaches 35° F. The exit aeration mode logic 43 effects shut down of the system when the controller is operating in the dry grain aeration mode and effects transfer to the drying mode to complete conditioning of the grain when the controller 30 is operating in the wet grain aeration mode.

The controller 30 also includes a clock 45 which provides timing signals for the controller circuits 30. The system clock includes a digital clock chip 46 which is operable when energized to supply timing inputs to a divider circuit 47 which provides timing outputs at the rate of 1 Hz, 1 c/hr, 1 c/day and 0.5 c/day. The clock chip 46 also drives a suitable digital clock display, which may include a LED display elements for indicating time of day.

The clock chip 46 is energized by an AC signal at a 60 Hz rate provided by power supply 49. The power supply 49 also supplies DC power at a level VCC to the circuits to the controller 30. A power switch 50 permits the controller circuits to be deenergized whenever the system is not in use.

A start switch 62 is manually operable to imitiate a dry/aeration operation. The start switch 62 when depressed enables the fan control logic 32 a reset switch 61 is manually operable to reset the circuits of the controller. A stop switch 63 is manually operable to reset the start switch 62 to shut down the system.

INITIALIZATION LOGIC

Considering the circuits of the controller 30 in more detail, the initialization logic 31 is preprogrammed to provide the control functions set forth in Table 1 as a function of harvest date, harvest moisture and air flow rate settings for selector switches 37–39.

TABLE I

INITIALIZATION MATRIX

| | Harvest Date | | | | | |
|---|---|---|---|---|---|---|
| | October 15 | | | November 1 | | |
| | Harvest moisture (%) | | | Harvest Moisture (%) | | |
| | 22 | 24 | 26 | 22 | 24 | 26 |
| Airflow rate | Control function | | | Control function | | |
| (cfm/bu) | D C H | D C H | D C H | D C H | D C H | D C H |
| 1.5 | F 2 $\overline{H}$ | U I $\overline{H}$ | U I $\overline{H}$ | F 2 $\overline{H}$ | F 3 H | U I $\overline{H}$ |
| 2.0 | F 2 $\underline{H}$ | U I $\underline{H}$ | U I $\underline{H}$ | F 2 $\underline{H}$ | F 3 H | S 5 H |
| 2.5 | F 2 $\underline{H}$ | F 2 $\underline{H}$ | U I $\underline{H}$ | F 2 $\underline{H}$ | F 2 H | S 4 H |
| 3.0 | F 2 H | F 2 H | U I H | F 2 H | F 2 H | F 3 H |

In Table I, Control function D is the output to the dry-down indicator 40 and U = unsuccessful, less than 90% chance of drying success;

F—fall finish, drying completed in the fall;

S = spring finish, drying completed in the spring.

Control function C is a counter preset for the fan control logic 32 and represents the number of weeks before enabling humidistatic control of the fan 13. A counter inhibit I is provided for combinations of input variables representing less that 90% chance of drying success.

Control function H is heater enable signal for the heater control logic 35.

The manner in which the initialization logic 31 is preprogrammed to provide the control functions set forth in Table I is described hereinafter.

For the selector switch settings illustrated in FIG. 2, that is, harvest date October 15, harvest moisture 22% and air flow rate 1.5 cmf/bu, the initialization logic 31 is preprogrammed to cause indicator lamp 40A to be lit, indicating fall completion of drying to provide counter presets to the fan control logic 32 to effect a two week delay before humidistatic control of the fan operation is provided, and to inhibit heater operation.

FAN CONTROL LOGIC

At the start of a drying operation, the fan control logic 32 effects continuous operation of the fan via solid state relay 33, and after the predetermined time delay established by the initialization logic, the fan control logic 32 is enabled to respond to humidistat, represented by contacts 71, to halt fan operation, limiting rewetting of the partially dried grain whenever the ambient relative humidity reaches or exceeds 90% for a period of three hours or greater.

The fan control logic 32 includes a week's delay counter 1108, shown in FIG. 11, which is preset with a programmed time delay, two weeks in the present example, established by the preset outputs provided by the initialization logic 31. The preset outputs of the initialization logic 31 are loaded into the counter 1108 in response to operation of a reset push button 61 at the start of the drying operation. Following the preset number of weeks, the fan control logic is enabled to respond to the humidity sensor the contacts 71 of which close whenever the ambient relative humidity becomes equal to or greater than 90%. The fan control logic also includes a three hour delay counter 1109 shown in FIG. 11 which defines the three hour delay before fan operation is halted. The fan is operated continuously whenever the grain temperature reaches or exceeds 45° F. as signaled by series connected contacts 72 of close-on-rise thermostats which are spaced vertically in the center and/or southwest quadrant of the grain mass.

FAN ALARM

A fan alarm includes a sail switch having normally open contacts 52 which are operated to close in response to air flow provided when the fan is operating. Contacts 52 control fan alarm logic 51 to energize a status lamp 53 whenever the fan control logic 32 provides an enabling output for the fan and contacts 52 fail to close signalling absence of air flow.

HEATER CONTROL LOGIC

At the start of the drying cycle, the heater control logic 35 is enabled, or is maintained disabled, as a function of the control output provided by the initialization logic. When enabled, the heater control logic 35 via solid state relay 36 energizes the heater 15. The heater control logic also energizes a status lamp 54 to indicate that the heater is enabled.

If enabled, the heater control logic 35 is disabled, causing the heater 15 to be deenergized during periods of ambient relative humidity equal to or less than 60% as signaled by contacts 74 of a close-on-fall thermostat. Also, an interlock is provided between the fan control logic 32 and the heater control logic 35 to permit heater operation only when the fan is operating.

The initialization logic 31 provides an enabling signal for the heater control logic 35 only when supplemental heat is required to complete drying or to provide fall completiion of drying for a given set of initial conditions. As indicated in Table I, for this embodiment, supplemental heat is employed for harvest data of November 1 and harvest moisture content of 24 or 26%.

EXIT DRYING MODE LOGIC

When the grain temperature reaches or falls below 35° F., as signaled by series connected contacts 73 of two closed-on-fall thermostats positioned near the top center and bottom of the grain mass, the exit drying mode logic 34 effects disabling of the heater control logic 35, if it is enabled, thereby deenergizing the heater 15. The exit drying mode logic 34 also enables the aeration logic 42, automatically transferring the controller operation from the drying mode to the aeration mode. As indicated above, the transfer from the drying mode to the aeration mode can also be effected manually by operating the aeration switch 41 from the off position to either the dry or wet position.

For late fall drying of grain, the effective drying period is approximately six to eight weeks after the harvest date. After such time, ambient temperature and humidity conditions generally preclude efficient drying. If the grain is not dried by the end of the fall drying period, the drying cycle is terminated and reinitiated in early spring. Partially dried grain, and dried grain which is stored over the winter for spring sale is periodically aerated to maintain the condition of the dried or partially dried grain. The entry to the aeration mode is effected automatically when the grain temperature decreases to 35° F. if the aeration switch is in the off position. A wet grain aeration cycle is initiated following automatic transfer from the drying mode to the aeration mode.

AERATION LOGIC

Generally, the transfer from the drying mode to the aeration mode is effected by the operator when the grain has dried to the desired condition. For purposes of this illustration, grain is defined as being dried when the average moisture content is 15% or less, the moisture content of the top layer is 16% or less and the maximum dry matter loss is 0.5% or less. The operator monitors the grain, and when the above criteria are met, the operator switches the aeration switch 41 to either the dry or wet position. It is pointed out, the dry down indicator 40 instructs the operator whether to employ the dry or wet aeration cycle. An indication of fall completion of drying, as signaled by indicator lamp 40A, instructs the operator to use a dry grain aeration cycle by operating the aeration switch to the position "dry". A spring completion of drying, indicated by lamp 40B, instructs the operator to use a wet aeration grain cycle and set the aeration switch 41 to the position "wet".

While the controller 30 is operating in the aeration mode, a primary or 12 hour aeration is initiated by a signal from a high low thermostat and a close-on-fall humidistat which operates to close series connected contacts 75 when ambient temperature is in the range of 30°–40° F. and ambient relative humidity is less than or equal to 75%. The aeration logic 42 responds to the closing of contacts 75 to enable the fan control logic 32 effecting energization of the fan 13 for the duration of a 12 hour period. For dry grain aeration cycles, the aeration logic 42 inhibits further aerations for a seven day period after the end of each 12 hour aeration cycle. After the seven day delay, the aeration logic is enabled to respond to sensor 75 and a primary aeration is initiated upon ambient temperature and humidity reaching the primary aeration limits.

The length of the primary aeration cycle, twelve hours, is selected to permit passage of both the leading and trailing edges of the temperature-transistion zone when minimum air flow is employed. Referring to FIG. 1, three distinct zones may be identified in the bin of grain undergoing low-temperature drying, namely, a dry zone 21 containing grain in equilibrium with the inlet air, and active drying zone 22 moving slowly in the direction of air flow, and a wet zone 23 containing undried grain in equilibrium with the exhaust air. Drying begins near the air inlet and proceeds in the direction of air flow as the drying zone advances through the drying mass. Whenever the fan is enabled, and the ambient temperature differs from the temperature of the grain, cooling or warming zones form and advance through the grain. Thus, once initiated, the fan operation is continuous for twelve hours which enables the entire temperature transition zone to move through the grain column.

The lower ambient temperature limit of 30° F. is selected to avoid blockage and spoilage problems that may arise from aggregate freezing of the grain. The upper limit of 40° F. is selected to maintain grain temperatures at a level restrictive to the growth of microorganisms. The upper limit of 75% for relative humidity is selected so that the equilibrium moisture content of the ambient air is maintained close to the average equilibrium moisture content of the grain, which is typically in the order of 16%.

The initiation of a primary aeration cycle is limited to the time interval of 12:00 p.m. to 12:00 a.m. since declining afternoon temperatures minimize the possibility of overheating the grain during the fixed-length aeration period.

Partly dried grain being held through winter for spring completion of conditioning requires greater aeration care than fall-dried grain because prolonged periods may be expected when ambient conditions fail to meet the primary aeration criteria. Accordingly, for wet grain aeration cycles, primary aerations are supplemented by secondary or three hour aeration period which is initiated under relaxed ambient restrictions. The secondary aerations are employed to minimize spoilage danger by cooling and equilizing grain temperatures.

For secondary aerations the primary aeration limits are relaxed or expanded to increase the probability of occurrence for secondary aerations. After a five day interval with ambient conditions failing to meet the primary aeration criteria, the aeration limits are altered to permit a secondary aeration when the ambient temperature is in the range of 15° to 45° F., as signalled by the closing of thermostatically controlled contacts 76. No restrictions on relative humidity or time of day are specified. The duration of the secondary aeration period, three hours, provides sufficient time to permit the leading edge of the temperature transition zone to be moved through the grain.

The wet-grain aeration cycle is summarized as follow:

1. A 12-hour aeration period is initiated by an occurrence of conditions within the primary aeration limits.
2. Following a primary aeration, further aerations are disallowed for a period of five days.
3. Primary aerations are enabled after the five-day wait period.
4. The absence of primary aeration conditions within two days of the wait period enables the secondary aeration limits.
5. A three-hour aeration period is initiated by an occurrence of conditions within the secondary aeration limits.
6. Following a secondary aeration, primary aeration limits are enabled.
7. The absence of primary aeration conditions within five days of a secondary aeration enables the secondary aeration limits.

EXIT AERATION LOGIC the exit aeration logic 43 responds to the presence of average daily temperatures equal to or greater than 35° F. to inhibit the aeration logic 42 and effect shutdown of the system if a dry grain aeration cycle proceeded the exit. If a wet grain aeration cycle preceeded the exit, the controller is transferred to the drying mode to complete conditioning of the grain. The exit aeration logic 43 responds to a close on rise thermostat which operates to close contacts 77 when the ambient temperature is equal to or greater than 45° F., and effects the exit from aeration mode for sensed temperature of 45° F. for two consecutive days.

OPERATION

The following is a general description of the operation of the controller 30 which makes reference to the flow diagrams given in FIGS. 3–8 along with the block diagram of the controller provided in FIG. 2.

For purposes of illustration, it is assumed that the controller circuits are energized and that the selector switches 37–39 are set as shown in FIG. 2 for a harvest date of October 15, harvest moisture of 22% and an air flow rate of 1.5 cfm/bu. Also, aerate switch 41 is assumed to be set to the "off" position. For such conditions, the initialization logic 31 provides control outputs, in accordance with Table I, which effect lighting of dry down indicator lamp 40A to indicate Fall completion of drying. The counter preset inputs supplied to the fan control logic 32 cause a delay of two weeks before humidistatic fan operation is provided. Also, heater operation is inhibited.

Figure 3:
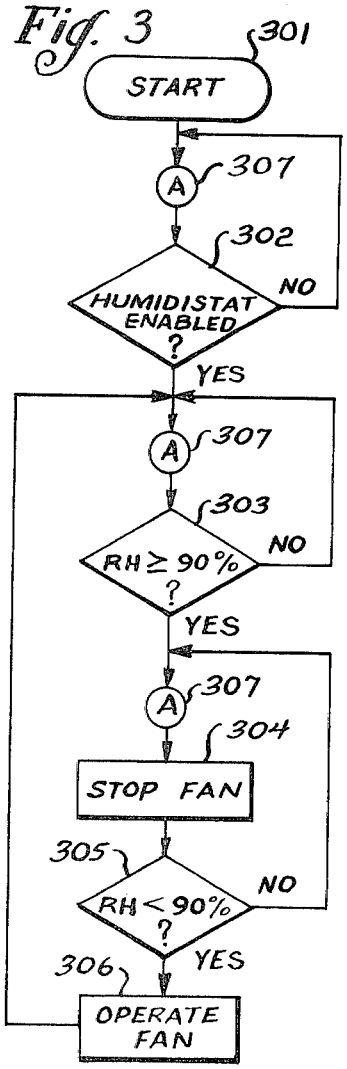

With reference to FIGS. 2 and 3, when the reset pushbutton 61 is operated at the start of the drying cycle, the weeks delay counter 1108 (FIG. 11) is loaded with the two week time delay period established by the initialization logic 31. At block 301, the controller enters the drying mode when the start pushbutton 62 is operated, and the fan control logic 32 via solid state relay 33 enables the fan to operate continuously during this period.

At block 302, the fan control logic 32 is enabled to respond to closing of the humidistat contacts 71 following the two week delay. At block 303, test is made to determine if the ambient relative humidity is equal to or greater than 90%, and if so, the fan control logic 32 stops the fan, block 304. At block 305, the state of contacts 71 is monitored to determine when the relative humidity decreases below 90%. At block 306, the fan is reenabled when relative humidity decreases below 90% and contacts 71 open. The sequence loops back to block 303 and humidistatic control of the fan continues for the balance of the drying operation unless the sequence is interrupted by a grain temperature equal to or greater than 45° F. This exit function is represented by the circles 307 and the exit sequence is shown in FIG. 4.

Figure 4:
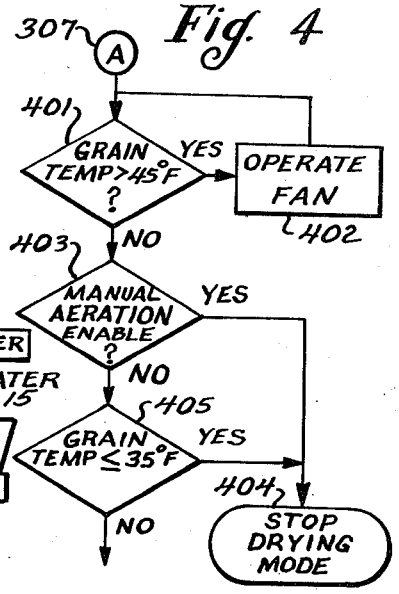
FIGS. 3 and 4 are flow diagrams illustrating humidistatic control of the fan during drying.

Referring to FIG. 4, upon entry to the exit sequence at block 401, a test is made for the grain temperature equal to or greater than 45° F., as signalled by the closing of contacts 72. At block 402, the fan is operated and the sequence loops back to block 401. Fan operation continues until the grain temperature falls below 45° F. When the grain temperature is less than 45° F., the status of the manual aeration switch 41 is tested at block 403 and if the switch is operated to either the "dry" or "wet" position, the drying cycle is terminated at block 404, and controller operation is transferred to the aeration mode. At block 405 fan operation or aeration is halted, if during the operating cycle the temperature of the grain decreases to 35° as signalled by the closing of contacts 73. When the grain temperature decreases below 45° F., but is greater than 35° F., the sequence returns to humidistatic fan control at block 302 (FIG. 3).

Figure 5:
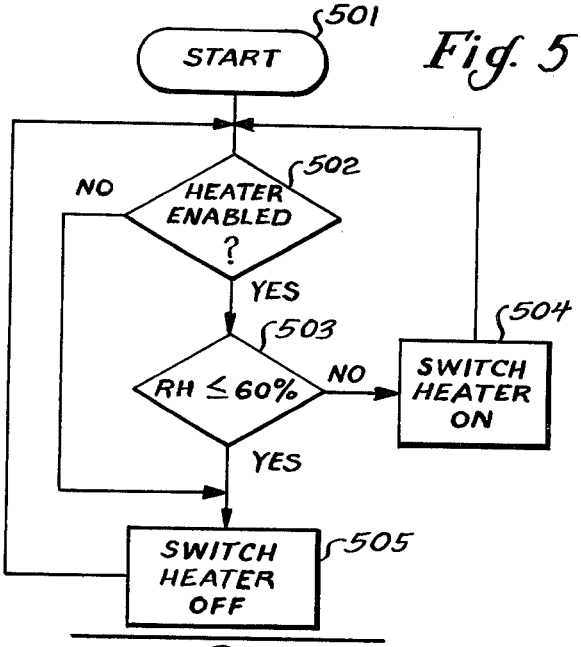
FIG. 5 is a flow diagram illustrating humidistatic operation of the heater during the drying mode.

Referring to FIG. 5, at block 501 is entry to the start of the drying cycle. At block 502, a test is made to determine if the heater is enabled or disabled in accordance with control functions provided by the initialization logic 31. In this example, the enabling signal for the heater control logic is not provided by the initialization logic and the heater is maintained deenergized. If, however, the heater were enabled, as would be the case for certain other sets of initial conditions, then at block 503 a test is made for relative humidity less than or equal to 60%. If not, the heater is switched on at block 504 and the sequence loops back to block 502. At block 505 the heater is switched off during periods of ambient relative humidity equal to or less than60%, as signalled by the close on fall thermostat contacts 74, and the sequence loops back to block 502. When the relative humidity thereafter rises above 60%, the heater is switched on, and the cycle continues until the exit from drying mode illustrated in FIG. 6.

Referring to FIG. 6, entry to the exit from drying mode is at block 601. For automatic exit from the drying mode, the exit drying mode logic 34 is enabled in response to the closing of thermostat contacts 73. At block 602, a test is made to determine if the heater is enabled. If so, at block 603 the heater is disabled. The sequence loops back to block 602. At block 604, a test is made to determine if the aeration switch 41 has been operated to the "dry" or "wet" position or is still in the off position. At block 605 if the switch 41 is in the off position, a test is made to determine if the grain temperature becomes less than or equal to 35° F. If so, at block 606, a wet grain aeration cycle is automatically initiated. If not, the sequence loops back to block 604.

The operator periodically monitors the condition of the grain, particularly near the end of the fall drying season, and operates the aeration switch 41 to initiate a dry aeration cycle as indicated by the dry down indicator 40. When the aeration switch 41 is manually operated from the off position to either the "dry" or "wet" position as determined at block 605, then at block 607, a test is made to determine if the switch 41 is at the "dry" or "wet" position. At block 606, a wet aeration cycle is initiated if the aeration switch 41 is operated to the "wet" position. At block 608, a dry aeration cycle is initiated if the switch is operated to the dry position.

A flow diagram of the aeration mode logic is presented in FIG. 7. At block 701, a dry or wet grain aeration cycle is initiated in exit from drying mode.

At block 702, the status of the aeration switch is tested to determine whether a dry or wet aeration cycle is to be provided. In the present example, where the aeration switch 41 is set to the position "dry", the operating sequence continues to block 703. At block 703, the aeration logic 42 is enabled to respond to the primary aeration conditions, designated as "event y". At block 704, a twelve hour aeration is effected. At the end of the twelve hour aeration, the aeration logic 42 provides a seven day delay, block 705 after which time the sequence returns to block 703, providing primary aerations whenever the primary conditions are met, until exit from aeration.

Assuming at block 702 that it is determined that the aeration switch 41 is set to indicate wet grain aeration cycle, then from the block 702, the operating sequence continues along the branch 706. At block 707, a test is made for the occurrence of conditions meeting the primary aeration limits, designated as event Y. At block 708, a twelve hour aeration cycle is initiated when primary limits are met. At block 709, after the twelve hour aeration cycle, the aeration control logic provides a five day delay period, during which time all aerations are prevented. At block 710, after the five day interval, the aeration logic is enabled to respond to the primary aeration limits. If the primary limits are met the sequency returns to block 706, and a primary aeration is effected as described above.

At block 711, if conditions meeting the primary aeration limits fail to occur within a two day interval following the end of the five day delay period, the aeration logic is enabled to respond to the secondary aeration limits, designated event z in block 712. At block 712, a test is made for conditions meeting secondary aeration conditions. At block 713, a secondary three hour aeration is initiated when the secondary aeration limits are met. Following the three hour aeration, the sequence returns to block 717 and the primary aeration limits are reenbled. At block 714, if the primary aeration limits fail to be met within five days, following a secondary aeration, then at block 712 the secondary aeration limits are reenabled.

Figure 7A:
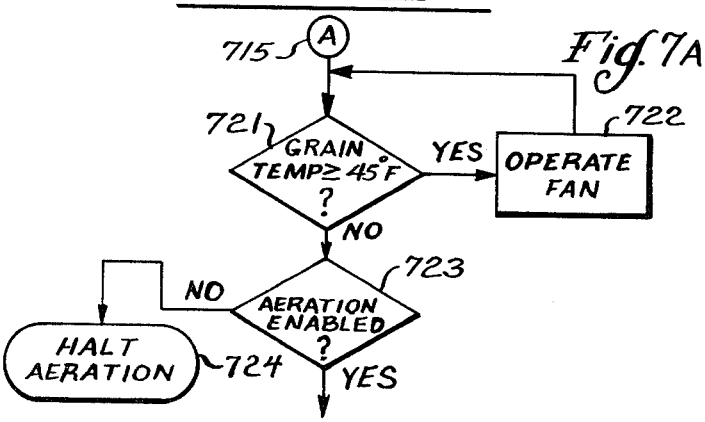

The aeration cycle is interrupted any time that the grain temperature becomes equal to or greater than 45° F. as indicated by the exit points 715. Referring to FIG. 7A the exit sequence, at block 721, the fan control logic responds to the closing contacts 72 and at block 722 enables the fan to operate continuously, overriding the aeration logic. When the temperature of the grain is reduced below 45° F., then at block 723 a test is made to determine if the aeration switch is operated to the "off" position. If not, the aeration cycle (FIG. 7) is reentered at block 707. If the aeration switch is off, then at block 724 the aeration cycle is terminated.

Figure 8:
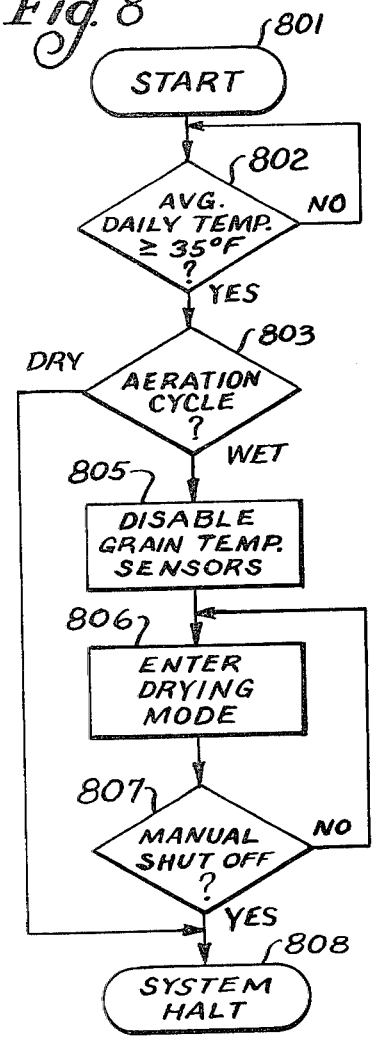
FIG. 8 is a flow diagram illustrating exit from aeration and system halt.

Referring now to FIG. 8, at block 801 is the entry to the exit from the aeration mode or system halt at block 802, when a daily average temperature equal to or greater than 35° F., is sensed, then at block 803, a test is made to determine if a dry grain aeration cycle preceeded the exit. If so, then at block 804, the system is shut down. If a wet grain aeration cycle preceeded the exit, then at block 806, the controller enters the drying mode to complete the conditioning of the grain. The drying continues until the system is halted by operation of the stop switch 63 by the operator, blocks, 807 and 804.

DETAILED DESCRIPTION OF CONTROLLER CIRCUITS

The following detailed description of the controller circuit makes reference to FIS. 10–16 of the drawings. The controller circuitry is implemented with CMOS devices to minimize poiwer consumption and susceptibility to noise. It is pointed out that the controller 30 employs "on-off" thermostats and humidistats as input sensors. Digital debounce circuits 28, such as the Motorola Type Eliminator Circuit Type MC14490 Contact Bounce (FIG. 2), interface the condition sensor contacts 71–77 with the logic circuits of the controller. The circuits 28 provide an inversion of its input condition, and an additional inverter must be provided to supply the desired logic state to the controller circuits. In the following descriptions of the controller logic circuits, labels, such as Ambient 14°–45° F., represent the occurrence of "true" state of a sensed condition indicated by the closing of the condition sensor contacts.

INITIALIZATION LOGIC

Referring to FIG. 10, the initializaton logic 31 includes a memory 1001 which stores twenty-four, eight-bit words, with different output words providing the control outputs necessary to effect different ones of the control functions set forth in the initialization matrix given in Table I. The memory 1001 is addressed as a function of the settings of the selector switches 37–39 to output a set of eight control signals over outputs Q0–Q7 for each of the twenty-four possible combinations of settings for the selector switches 37–39. The counter inhibit signal is provided over output Q0 and extended to the fan control logic 32 to inhibit the weeks delay counter 1108 (FIG. 11) for initialization settings indicating an unsuccessful drying cycle. The counter presets are provided over outputs Q1–Q3 for the weeks delay counter 1108. Signals provided on outputs Q4–Q6 control lighting of one of the three dry down indicator lampes 40A–40C for indicating spring drying, fall drying, and unsuccessful drying cycle, respectively. A signal Heater Enable is provided over output Q7 and extended to the heater control logic 53.

The memory 1001 comprises a type N822 256-bit programmable read only memory organized into thirty-two, eight bit words. Only twenty-four of the word storage locations are used in the exemplary embodiment. The initialization logic 31 can be programmed to accept values for harvest data, harvest moisture, or air flow rate, other than those specified for the exemplary embodiment, with the additional control words being stored in the unused storage locations. Also, it is apparant that a memory of greater storage capacity would be employed in applications where more than thirty-two control words are used.

The memory 1001 is addressed over five address inputs A0–A4, input A0-being controlled directly by the harvest date switch 37, and inputs A1–A4 are controlled by the harvest moisture switch 38 and air flow rate switch 39 via an address decoder 1002.

The address decoder 1102 is comprised of two type 80C 97 three-state hex buffer circuits 1003 and 1004, which have their data inputs controlled by signals generated in accordance with settings of the air flow rate switch 39. Disabling inputs of the circuits 1003 and 1004, which select the state of the circuits 1003 and 1004, are controlled by signals provided by setting of the harvest moisture switch 38. Inverters 1005, interposed between switch 39 and inputs of circuits 1003 and 1004 provide voltage translations enabling the circuits 1003 and 1004 to provide the required outputs to address inputs A1–A4.

By way of example, with the selector switches 37–39 set as indicated in FIG. 10 to indicate a harvest date of October 15, a harvest moisture of 22% and an air flow rate of 1.5 cfm/bu, the eight-bit control word read out of the memory 1001 effects the control functions for this set of initial conditions in accordance with the initialization matrix given in Table I. That is, the bits provided at outputs Q0, Q4, Q6, and Q7, representing the counter inhibit, spring completion, unsuccessful completion and heater enable, respectively are false or logic 0 levels, and the bit provided at output Q5, representing fall completion of drying is true or logic 1 level. Also the three bits provided at outputs Q1–Q3, the counter presets, cause the week delay counter 1108 to be set to a count to provide two week delay.

PROGRAMMING OF INITIALIZATON LOGIC

The following description indicates the manner in which the initialization logic 31 is preprogrammed to output these control functions.

As indicated above, the low-temperatures process is governed by independent variables including air flow rate, harvest moisture content and amount of heat added, harvest date and prevailing weather conditions. These independent variables detemine the drying time, the final moisture content of the grain, and the extent of grain deterioration during drying. The control functions set forth in the initialization matrix (Table I) were derived from data obtained from computer simulations using a computer model of the low temperature grain drying/aeration process. The results of computer simulations were used to establish the probability of drying success (control function C) for a given set of initial values for harvest date, harvest moisture, temperature rise, average weather conditions, and air flow rate. These simulations also indicated whether or not the use of supplemental heat (control function H) was desireable. Further simulations were used to predict when the grain would be dried to prescribed criteria allowing a determination as to whether completion of drying would occur in the fall or be delayed until spring. The results of these similations are reflected in the selection of control function D. A third series of drying simulations were conducted to predict the number of weeks in the drying period until specified moisture content values and grain temperatures were achieved. The simulations enabled prediction of the number of weeks into the drying period (control function C) before humidistatic control of the fan can be employed without jeopardizing allowable storage time.

A low-temperature aeration model developed by T. L. Thompson was used to simulate low temperature drying operation. The model is described in transactions of the American Society of Agricultural Engineers Vo. 15. No. 2 pages 333–337. The Thompson model relates the dependent process variables of drying time, final moisture content and extent of grain deterioration to the independent variables including air flow rate, harvest moisture content, amount of heat added, harvest date and prevailing weather conditions. Official weather data are used in simulating the effects of variable weather conditions during conditioning and storage of the grain. The model predicts grain temperature, moisture content and dry matter decomposition resulting from (a) respiration within the grain, (b) heat transfer through the bin wall, and (c) conditioning of the grain through continuous low-temperature drying-aeration.

WEATHER DATA ANALYSIS

To obtain weather data for use in the computer simulations using the Model, twenty-eight years of longterm Des Moines, Iowa weather data were analyzed to establish weather-related parameters. The data consisted of dry bulb and dew point temperatures at three-hour intervals for the drying seasons of 1945 through 1972. From this information, weekly, bi-weekly, and monthly arithmetic means were calculated for dry bulb temperature, wet bulb temperature, dew point temperature, relative humidity and shelled corn equilibrium moisture content. The wet-bulb temperature values were obtained using the equations presented by D. B. Brooker reported in the transactions of the American Society of Agricultural Engineers, Vol. 10, No. 4 pages 558–560 and 563. The values of relative humidity were obtained using the equations presented by Tsing Ya Sun in the 1971 edition of heating, Piping and Air Conditioning Vol. 43, No. 10, pages 98–100. Values of equilibrium moisture content were obtained using equations presented by C. W. Chen and J. T. Clayton in the 1970 ASAE paper No. 70-383 of the American Society of Agricultural Engineers, St. Joseph, Michigan.

The weather data for the twenty-eight year period were analyzed to determine the average monthly values of dry-bulb temperature, and relative humidity for September through May of each year.

The computer simulations employed weather data for the years 1960–1969 for Des Moines, Iowa, and thus the programming of the initialization logic 31, and the set point values for condition sensors 29 selected provide optimum conditioning of grain in locales having similar weather conditions. When the system of the present invention is used in locales having weather conditions which differ from those of Des Moines, Iowa, computer simulations of the low-temperature drying process would be run using "average" weather data for such locales to obtain control parameters required to program the initialization logic and to select set points for the conditions sensors.

Although the Thompson model is designed to accept weather data consisting of three-hour readings, the model was programmed to average the data over a diurnal period and perform the season simulation using twenty-four hour average values input.

PROBABILITY OF DRYING SUCCESS

In order to establish the probability of drying success with a given set of initial conditions, simulations of the low temperature drying process were conducted using the Thompson model with Des Moines, Iowa weather data for the drying seasons of 1960–1969. For each season, the minimum required air flow rate was calculated for a specific combination of harvest date, harvest moisture content and air temperature rise. The values for the independent variables employed for the simulation runs were harvest dates, October 15 and November 1; harvest moisture, twenty-two, twenty-four and twenty-six percent; and temperature rise, 2 and 5° F. For each combination of independent variables and drying season, the minimum required air flow for successful drying was calculated, providing ten sets of data for each combination of initial conditions. The date resulting from these simulations are set forth in Table II, which is appended to the application.

Figure 9:
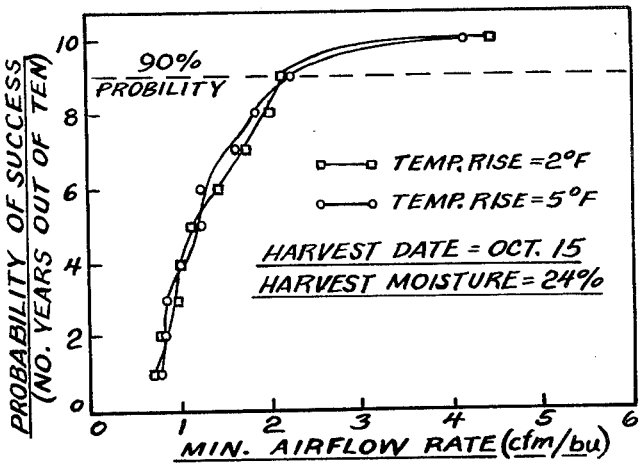
FIGS. 9 and 9A illustrate probability of drying success versus air flow rate for given temperature rise, harvest date, and harvest moisture.
Figure 9A:
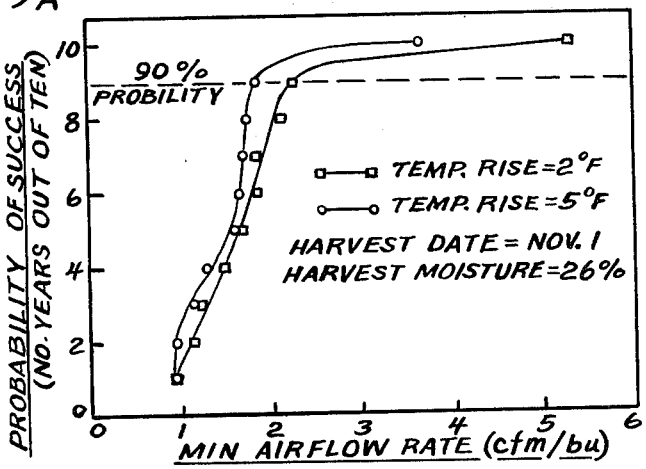

In Table II, the resultant values of minimum air flow are arranged in assending order. The ten data points of each set of initial conditions were plotted to indicate the probability of drying success as a function of air flow rate. Two such plots are shown in FIGS. 9 and 9A. The minimum air flow rate for the drying success of nine out of ten drying seasons, that is 90% probability levels, are identified on the two graphs.

Referring to FIG. 9, which shows the probability of success for minimum air flow rates for initial conditions of harvest data of October 15 and harvest moisture of 24% and temperature rises of 2° F. and 5° F., it is seen that for the simulations using the initial conditions specified, there is less than a 90% probability of success for air flow rates of 2cfm/bu or less. Accordingly, as shown in Table I, the dry down indicator function D is selected to indicate an unsuccessful, or less than 90% chance of drying success, for air flow rates of 1.5 and 2.0 cfm/bu for the specified initial conditions.

Referring to FIG. 9A, which shows probability of success for minimum air flow rate for initial conditions of harvest date of November 1, harvest moisture of 26% and temperature rises of 2° F. and 5° F., it is seen that a 90% probability of success is achieved for air flow rates of 2cfm/bu or greater when supplemental heating is provided, but that a 90% probability of drying success is not assured for air flow rates less than 2cfm/bu with or without heating. Accordingly, in Table I, for these initial conditions, an unsuccessful drying cycle is indicated for air flow rate of 1.5cfm/bu, and successful drying operations are indicated for air flow rates of 2cfm/bu or greater with the heater enabled.

The other simulation data were analyzed in a similar manner to generate the probability of drying success, represented by control function D, and the desirability of heater operation, represented by control function H. Analysis of the data obtained from the initial conditions indicate that heater operation was desirable for combinations of initial conditions of which the harvest date was November 1 and moisture contents were 24 and 26%. Priority was given to the greater likelihood of fall completion of drying resulting from the use of supplemental heat.

COMPLETION OF DRYING

In order to predict whether completion of drying will occur in the fall or be delayed until spring, a second series of drying simulations was conducted. Successful combinations of independent variables, that is the combinations which yield a probability of success of 90% or greater, where programmed with weather data from the next-to-worse case drying season.

The extent of the fall drying season can be established from long term Des Moines, Iowa weather records. Following the first week in December, the mean weekly dry bulb temperature drops sharply below 32° F., and air at or below this temperature has little useful drying potential. Also, at this time the weekly mean equilibirium moisture content for a 2° temperature rise climbs rapidly above 16%. Thus the end of the fall drying season in central Iowa can be located early in the second week of December. Using this criteria, the number of weeks to the end of the fall drying season is defined as eight weeks to finish for an October 15, harvest date and six weeks to finish for a November 1 harvest date.

For purposes of this illustration, grain is defined as being dry when the average moisture content is 15% or less, the moisture content of the top layer is 16% or less and the maximum dry matter loss is 0.5% or less.

For the simulation runs using the assumed initial conditions and the criteria set forth above, the computer outputs indicated the time required for the grain to be dried. For most cases, drying was completed before the end of the fall drying season. However, for initial conditions of harvest date of November 1, harvest moisture of 26% and air flow rates of 2 and 2.5 cfm/bu, the data indicated spring completion of drying. The results of these simulations are reflected in the selection of dry down indicators (control function D) listed in Table I.

HUMIDISTATIC FAN CONTROL

In order to predict the number of weeks in the drying period before fan operation may be interrupted without jeopardizing allowable storage time (control function C), a further series of low-temperature drying simulations was conducted, using average weather data, to determine when the average grain moisture content was 18%, the moisture content of the top layer of the grain was 22%, and the temperature of top layer of the grain was 45° F.

The resultant data provides the predicted average safe delay time, in weeks, before humidistatic control of fan operation can be enabled. These data are reflected in the selection of counter presets listed in Table I. A humidistat "inhibit" I is specified for each of the previously defined unsuccessful combinations.

The frequency of occurrence of ambient conditions favoring fan interruption was estimated by conducting an analysis of ten years of Des Moines weather data. A computer program was written to identify weather periods of three hours, or longer, with ambient conditions as follows: Relative humidity ≧90% and Dry bulb temperature ≦45° F.

The results indicated that, between November 1 and December 15, the above criteria can be expected during 10 percent of the overall period, and between March 16–April 15 the above criteria can be expected during 8 percent of the period.

FAN CONTROL LOGIC

Referring to FIG. 11, the fan control logic 32 includes gate 1101 which generates a signal Fan Enable for the fan driver 33 during drying and aeration modes. The fan control logic also includes humidistatic fan control logic indicated generally at 1104, including the weeks delay counter 1108, and the three hour delay counter 1109, which inhibit fan operation during prolonged periods of high humidity following the delay control interval defined by the weeks delay counter.

Gate 1101 is enabled by the signal Start which is generated when the start switch button 62 is depressed by the operator. During drying operation, and when the humidistatic fan control logic 1104 is disabled, gate 1106 generates an enabling signal which via OR gates 1105 and 1103 enables gate 1101 to follow the signal start and effect fan operation.

Gates 1102 and 1103 generate a signal for enabling gate 1101 to effect continuous fan operation whenever the grain temperature reaches or exceeds 45° F. as signalled by the closing of contacts 72. During aeration cycles, gate 1105 responds to the signal Aerate provided by the aeration logic 42 to generate an enabling signal which via gate 1103 enables gate 1101 during aeration cycles.

Considering the humidistatic fan control circuits 1104, the weeks delay counter 1108 is a type 74B193, synchronous four-bit binary counter which is connected for count down operation. The counter 1108 is preset to the count indicated by the count present outputs which are provided by the initialization logic 31. The counter presets are loaded into the counter 1108 in response to operation of the reset switch 61 at the start of the drying cycle. It is pointed out that the count loaded into counter 1108 corresponds to twice the number of days in the designated number of weeks, and the counter 1108 is driven by timing pulses at the rate of 0.5 cycles per day. The timing pulses are extended to the count down input of counter 1108 over gate 1110 which is enabled in the absence of signal Counter Inhibit which is provided by the initialization logic 31 whenever the combination of initial conditions represents an unsuccessful drying operation.

An AND gate 1112 combines signals representing the state of the counter 1108 and the condition of the ambient relative humidity sensor, and is enabled after the delay interval established by counter 1108 to cause the fan to be disabled whenever the ambient relative humidity is 90% or greater for a three hour period defined by the three hour delay counter 1109. When enabled, gate 1112 generates a signal which via gate 1113 enables a one shot circuit 1114 to load the three hour delay counter 1109 to a count of three. The counter 1109 is also a type 74C193 synchronous four bit binary counter connected for count down operation.

Timing pulses at the rate of one cycle per hour are gated to the countdown input of the counter 1109 by AND gates 1115 which is primed by gate 1112 when it is enabled. When gate 1112 is enabled, its output also primes gate 1116. Gate 1116 is enabled when the three hour delay counter 1109 reaches a count of zero, and generates an inhibit signal which effects disabling of gate 1101 via gates 1124, 1106, 1105 and 1103, terminating the signal Fan Enable. Gate 1124 logically combines the output of gate 1116, as inverted by inverter 1117 with signal Aeration Mode, inverted by inverter 1125, provided by gate 1503 (FIG. 15).

To initiate a drying operation, the operator first depresses the reset push button 61 generating signal Reset to cause the counter presets to be loaded into the weeks delay counter 1108. The operator then depresses the start push button, generating the signal Start which enables gate 1101 to generate signal Fan Enable. The fan is enabled and runs continuously until humidistatic control is enabled.

Timing pulses at the rate of 0.5 cycles per day, gated to the weeks delay counter 1108 over gate 1110, are counted down by the weeks delay counter 1108. When the counter 1108 reaches a count of zero, its borrow output goes low, which output via inverter 1119 arms gate 1112, enabling it to follow the status of the ambient relative humidity sensor contacts 71. The operation of the fan 13 is then under humidistatic control for the balance of the drying cycle.

If during this time the ambient relative humidity becomes equal to or greater than 90%, humidistat operates to close contacts 71, enabling gate 1112 and its output, via gate 1113, triggers the one-shot circuit 1114, loading the three hour delay counter 1109 with a count of three. Gate 1115 is enabled to gate the timing pulses at the rate of one cycle per hour to the count down input of the three hour delay counter 1109. When the counter 1109 has counted down to zero, indicative that the relative humidity has remained at 90% or better for three hours, the borrow output of counter 1109 goes low, and via inverter 1120 enables gate 1116 which is primed at this time by the output of gate 1112. The output of gate 1116, goes high, and as inverted by inverter 1117, disables gate 1124 causing its output to go low. Accordingly, the outputs of gates 1106, 1105 and 1103 go low, disabling gate 1101 to terminate the signal Fan Enable.

When the relative ambient humidity decreases below 90%, gate 1112 is inhibited thereby inhibiting gate 1116, and gate 1101 is reenabled to generate the signal Fan Enable. It is pointed out that if the relative ambient humidity becomes less than 90% during the three hour delay defined by counter 1109, gate 1116 remains disabled and fan operation is not inhibited.

During aeration cycles, when the signal Aerate is true, this signal via gates 1105 and 1103 maintains gate 1101 enabled to keep the fan operating during the aeration cycles. Whenever grain temperatures of 45° F. or greater are sensed, as signalled by the closing of contacts 72 gate 1102 is enabled and its output via gate 1103 enables gate 1101 to provide fan operation for cooling the grain.

At exit from aeration when a wet grain aeration cycle preceeds the exit, the signal Disable Grain provided by the exit from aeration mode logic goes low and inhibits gate 1102. This prevents the fan control logic 32 from responding to the closing of contacts 72.

FAN ALARM LOGIC

Figure 12:
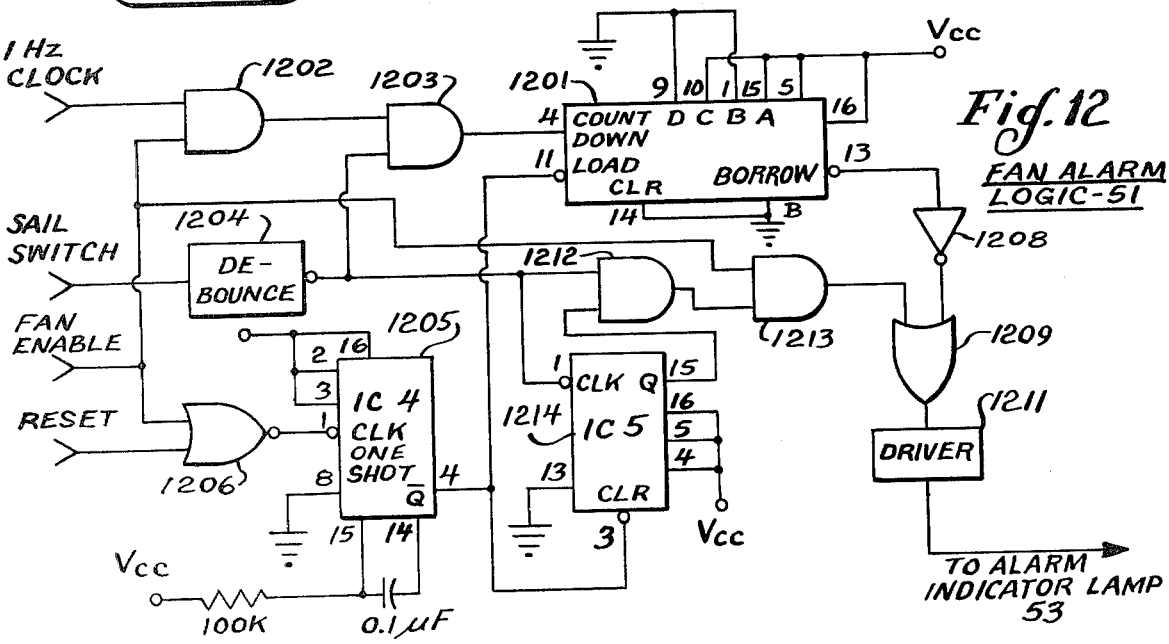
FIG. 12 is a schematic circuit diagram of fan alarm logic of the controller.

Referring to FIG. 12, the fan alarm logic 51 responds to the signal Fan Enable to effect energization of the fan alarm indicator 53 whenever the sail switch contacts 52 fail to close within five seconds after the signal Fan Enable is provided. The fan alarm logic 51 also effects energization of the fan alarm indicator 53 upon loss of air flow during an operating cycle.

The five second interval is defined by a counter 1201. The counter 1201 which is a type 74C193 synchronous four-bit binary counter connected for countdown operation, has count preset inputs A-D hard-wired to VCC or ground as shown, to permit the counter 1201 to be set to a count of five with the application of a load pulse to its load input. The load pulse is provided by one shot circuit 1205 which receives a trigger pulse from gate 1206 in response to either signals Fan Enable or Reset.

Timing pulses at a one Hz rate are extended to the countdown input of the counter 1201 over timing gates 1202 and 1203. The signal level at the borrow output of the counter 1201, as inverted by inverter 1208, is applied to an input of OR gate 1209 which enables a fan alarm driver 1211 to energize the fan alarm indicator whenever the counter 1201 reaches a count of zero or gate 1213 is enabled, indicating loss of air flow.

For the purpose of detecting loss of air flow once fan operation has been established, gate 1213 and gate 1212 under the control of flip flop 1214, logically combine the status of the sail switch contacts 52 and signal Fan Enable to provide an enalbing signal which via gate 1209 enables the fan alarm driver 1211 whenever contacts 52 of the sail switch reopen while signal Fan Enable is true.

In operation, assuming initially the fan 13 is deenergized so that sail switch contacts 52 are open, then when signal Fan Enable is provided, the one-shot circuit 1205 is triggered via gate 1206 and loads the count of five into counter 1201. The signal provided by the one-shot 1205 also resets the flip flop 1214. Timing pulses at the 1 Hz rate are extended to the countdown input of the counter 1201 over gate 1202, which is enabled by signal fan enable, and gate 1203 which is enabled by the output of debounce circuit 1204 when sail switch contacts 52 are open.

Assuming the fan is operating properly and air flow is sensed by the sail switch, its contacts 52 close and the output of debounce circuit 1204 goes low, inhibiting gate 1203 thereby preventing further timing pulses from being supplied to the counter 1201 and the fan alarm indicator remains deenergized until signal Fan Enable goes false at the end of the operating cycle.

If there is an interruption of air flowing during the operating cycle, the sail switch contacts 52 open and the output of debounce circuit 1204 goes high, setting flip flop 1214 and arming gate 1212 which is then enabled by the Q output of the flip flop 1214 generating an inhibit signal via gate 1213 which is enabled by signal Fan Enable and 1209 to enable the alarm driver 1211 causing lamp 53 to be lit.

HEATER CONTROL LOGIC

Referring to FIG. 13, the heater control logic 35 includes AND gate 1301 and NAND gate 1302 which respond to signals Heater Enable and Ambient RHΘ60% to generate an enabling signal which is gated over a fan/heater interlock AND gate 1303, to the heater driver 36 whenever signal Fan Enable is true. Gate 1301 is enabled whenever the signal Heater Enable is true and signal $\overline{\text{Heater Disable}}$, generated by the exit from drying logic 34, is true. The output provided by gate 1301, when it is enabled, via driver circuit 1306, energizes the heater enable status lamp 54, and is applied to an input of NAND gate 1302 which has a second input maintained high whenever the ambient relative humidity is greater than 60%. The output of gate 1302 is normally high when signal Heater Enable is true so that when signal Fan Enable is true, gate 1303 is enabled to energize heater driver 36.

In operation, when signal Heater Enable is provided by the initialization logic 31, and assuming signal $\overline{\text{Heater Disable}}$ is true, then gate 1301 is enabled and the heater status lamp 54 is lit. Also, gate 1302 is armed to follow the status of the relative humidity sensor and its output is high whenever the ambient relative humidity is greater than 60%. Under such conditions, when signal Fan Enable goes high, gate 1303 enables the heater driver 36 to energize the heater.

When the ambient relative humidity becomes equal to or less than 60%, gate 1302 is enabled and its output goes low disabling gate 1303 thereby effecting deenergization of the heater. Upon exit from drying mode, signal $\overline{\text{Heater Disable}}$ goes low either in response to operation of the aeration switch 41 or to closing of contacts 73, indicating grain temperatures equal to or less than 35° F. Gate 1301 is disabled, and its output goes low, causing the heater status lamp 54 to be extinguished, and causing gate 1303 to be disabled, effecting deenergization of the heater.

EXIT FROM DRYING MODE LOGIC

Referring to FIG. 14, the exit from drying mode logic 34 includes NOR gate 1401 and OR gate 1402 which combine the status of the aeration switch 41 and the status of contacts 73 of the grain temperature sensor, and generate signals $\overline{\text{Heater Disable}}$ and Wet Aeration Cycle, respectively. The signal Dry Aeration Cycle is derived directly from the aeration switch 41.

Gate 1401 responds to either signal Select Dry Aeration or Select Wet Aeration provided when the operator moves the aeration switch 41 from "off" to either "dry" or "wet" to cause signal $\overline{\text{Heater Disable}}$ to go low. Gate 1402 responds to signal Select Wet Aeration to enable an AND gate 1402 which generates signal Wet Aeration Cycle. Gate 1402 also responds to the singal output of the grain temperature sensor to enable gate 1403 to generate signal Wet Aeration Cycle, providing automatic transfer from the drying mode to the aeration mode when the grain temperature becomes equal to or less than 35° F.

AERATION LOGIC

Figure 15A:
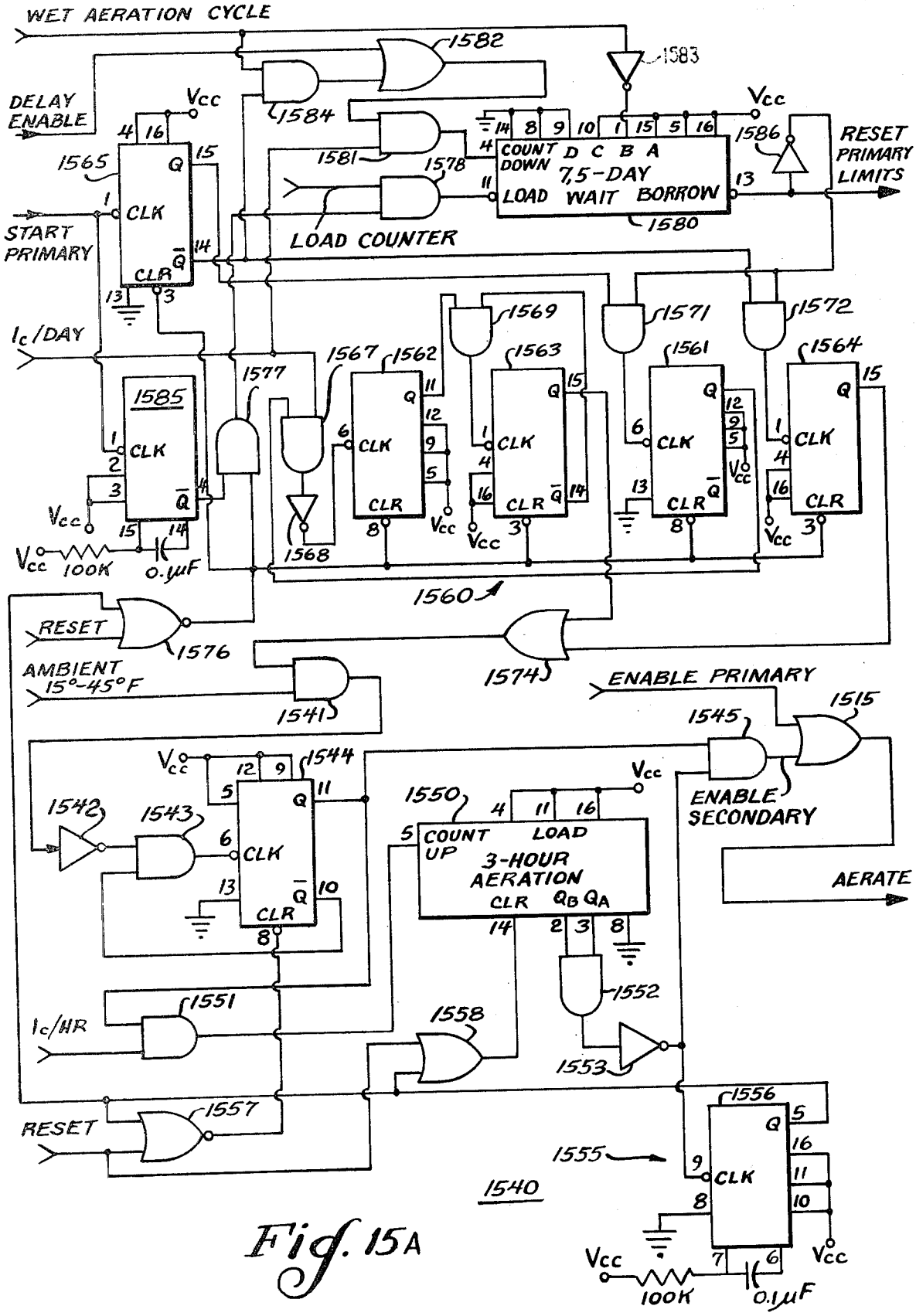

The elements of the aeration logic 42 are set forth in schemtic circuit diagram form in FIGS. 15 and 15A. The aeration logic 42 is enabled to effect either a dry grain aeration cycle or a wet grain aeration cycle in response to signals Dry Aeration Cycle and Wet Aeration Cycle, respectively. The composition and operation of the aeration control logic 42 is described with reference to the operating schemes for dry grain aerations and wet grain aerations.

DRY GRAIN AERATION LOGIC

The dry/grain aeration cycle is summarized as follows:

1. A twelve hour aeration period is initiated by conditions meeting the primary aeration limits, namely ambient temperature in the range of 30°–40° F. and ambient relative humidity less than or equal to 75%, and time of day between noon and midnight.

2. Following a primary aeration cycle, further aerations are disallowed for a period of seven days.

3. After the sever day delay, primary aerations are permitted when the primary aeration limits are met.

With reference to FIG. 15, primary aeration logic 1501, which includes gates 1502–1507 and flip flop 1509, responds to the closing of condition sensor contacts 75 (FIG. 2), indicating ambient temperature and in the range of 30°–40° F. and relative humidity less than or equal to 75%, and to timing pulses at the rate of one cycle per day, which are indicative of time of day, to generate a signal Enable Primary via gate 1512. Signal Enable Primary enables an OR gate 1515 (FIG. 15A) to generate the signal Aerate for the fan control logic 32.

The signal Dry Aeration Cycle, provided when the aerate switch 41 is operated to position "dry", is extended over OR gate 1503 to one input of AND gate 1504 which has a second input connected to the output of AND gate 1502. Gate 1502 is enabled whenever the primary limits are met, that is, when contacts 75 (FIG. 2) are closed. Gate 1502 is driven by timing pulses at the rate of one cycle per day. Thus when contacts 75 close indicating that the primary limits of ambient temperature and relative humidity are met, gate 1502 is enabled only for a positive or logic 1 level state of the timing pulse indicating time of day to be between noon and midnight. When gate 1502 is enabled, its output via gates 1504–1507 sets flip flop 1509 to initiate the twelve hour primary aeration period.

The twelve hour aeration period is defined by a twelve hour counter 1514 which is a type 74C193 synchronous four-bit binary counter connected for count up operation. Timing pulses at a one cycle per hour rate are gated to the count input of the counter 1514 over gate 1510 which is enabled when flip flop 1509 is set. The flip flop 1509 is reset when the counter 1514 reaches a count of twelve, signifying the end of the primary aeration.

When counter 1515 reaches a count of twelve, a reset circuit 1516, including a one shot circuit 1517 and gates 1518-1521, effects reset of flip flop 1509, clearing of counter 1514, and setting of a flip flop 1522.

When set, flip flop 1522, via its false output $\overline{Q}$ inhibits a primary limit gate 1505 to "disable" the primary limits, and via its true output Q generates a signal Delay Enable which enables a gate 1531 to gate one cycle per day clock pulses to a seven day counter 1530, which defines the seven day wait period following a primary aeration.

counter 1530 is a type 74C193 counter connected for count down operation. The counter is preset to a count of seven and then counts down timing pulses occurring at the rate of one cycle per day. During the seven day wait period, gate 1505 is inhibited by flip flop 1522, "disabling" the primary limits. When the counter 1530 reaches a count of zero, signifying the end of the seven day waiting period, gate 1505 is reenabled, permitting the primary aeration circuitry 1501 to respond to the primary conditions and effect a further primary aeration cycle.

After the seven day wait period, the seven day counter enables a further reset circuit 1527, including gates 1533 and 1534 and one shot circuit 1535, to reset flip flop 1522 to reenable gate 1505, and, via gate 1521, to clear flip flop 1509. The one-shot circuit 1535 also provides a load pulse to the seven day counter 1530, which has its counter preset input wired to VCC and ground, as shown, to be preset to a count of seven.

The aeration logic circuits are reset to initial states in response to the signal Reset, provided whenever the operator depresses the reset pushbutton 61. The signal Reset via gate 1520 clears the counter 1514, and via gates 1533 and 1534 triggers one shot circuit 1535 which generates a reset signal for flip flops 1509 and 1522.

WET GRAIN AERATION LOGIC

Primary aerations for wet grain aeration cycles are effected by the circuitry, shown in FIG. 15, used for the dry grain aeration cycles. The circuitry which provides the secondary aerations is shown in FIG. 15A. The wet-grain aeration cycle is summarized as follows:

1. A twelve-hour aeration period is initiated by an occurrence of conditions within the primary aeration limits.

2. Following a primary aeration, further aerations are disallowed for a period of five days.

3. Primary aerations are enabled after the five day wait period.

4. The absence of primary aeration conditions within two days of the wait period enables the secondary aeration limits.

5. A three-hour aeration period is initiated by an occurrence of conditions within the secondary aeration limits.

6. Following a secondary aeration, primary aeration limits are enabled.

7. The absence of primary aeration conditions within five days of a secondary aeration enables the secondary aeration limits.

Referring to FIGS. 15A, secondary aeration control logic 1540 includes gates 1541-1543 and flip flop 1544. When enabled, the secondary/aeration logic 1540 responds to the closing of contacts 76, indicating ambient temperature in the range of 15°–45° F., to generate a signal Enable Secondary via gate 1545. Signal Enable Secondary enables gate 1515 to generate signal Aerate for the fan control logic 32.

A three hour counter 1550 and associated gate circuits 1551–1553 define the duration of the secondary aeration. A five/seven day counter 1580 defines the five day delay interval for inhibiting aerations after a primary aeration and for enabling the secondary aeration limits for the absence of primary conditions within five days of a secondary aeration.

The five/seven day counter 1580 is a Type 74C193 counter connected for count down operation. For wet aeration cycles, the counter 1580 is loaded with a count of five and following a primary aeration timing pulses at a 1C/day rate are gated to the clock input of the counter over AND gate 1581. Gate 1581 is enabled by signal Delay Enable provided by flip flop 1522, which is extended to gate 1581 via OR gate 1582.

Counter 1580 is designated a five/seven day counter because its preset inputs set the counter to a count of seven for dry aeration cycles and to a count of five for wet aeration cycles. This variable programming is provided by "conditioning" one of preset inputs upon the presence or absence of the signal Wet Aeration Cycle, which is supplied to the counter present input over interter 1563. The counter 1580 is loaded in response to a load pulse generated either by a one-shot circuit 1585 which is triggered when flip flop 1509 is set, or by a pulse provided by one-shot circuit 1535 which also loads counter 1530.

The enabling of the secondary limit gate 1541 after two day following the five day wait period after a primary aeration is effected by a two day delay circuit 1560. The circuit 1560 includes a flip flop 1561 and a divide by two circuit 1566 comprised of flip flops 1562 and 1563 and associated gates 1567–1569. The pulse divider circuit 1566 receives timing pulses at the rate of one cycle per day gated thereto over AND gate 1567 and inverter 1568 whenever gate 1567 is enabled.

The enabling of gate 1567 is controlled by the true output Q of flip flop 1561. The state of flip flop 1561 is in turn controlled by gate 1571 which logically combines the status of the five day counter 1580 and a flip flop 1565.

The flip flop 1565 is set in response to a negative going pulse applied to its clock input when flip flop 1509 (FIG. 15) is set. When flip flop 1565 is set, its true output goes high enabling gate 1571 to follow the state of counter 1580 and to be enabled when the borrow output of the counter 1580 goes low. When the five day counter 1580 is thereafter reloaded with a count of five under the control of one shot circuit 1535, the borrow output of the counter 1580 goes high and gate 1571 is disabled providing a negative going clock pulse to the clock input of flip flop 1561, causing its true output Q to go high to enable gate 1567. The divider circuit 1566 responds to two clock pulses to generate an enabling signal at the true output Q of flip flop 1563 which is extended over an OR gate 1574 to the enable secondary aeration limit gate 1541 to follow the status of secondary aeration sensor contacts 76 (FIG. 2). Contacts 76 close whenever ambient temperature in the range of 15°–45° C., is sensed.

Gate 1541 controls the enabling of the secondary aeration control logic 1540 which is generally similar to the primary aeration control logic 1501. That is, when the secondary limit gate 1541 is enabled, gate circuits including inverter 1542 and AND gate 1543 generate a negative going clock pulse for setting flip flop 1544. When set, flip flop 1544 via its true output Q enables an AND gate 1545 to generate a signal Enable Secondary Aeration to initiate a three hour secondary aeration. Gate 1515 responds to this signal to generate the signal Aerate to generate the signal aerate for the fan control logic, and to enable timing pulses at the rate of one cycle/hr. to be gated to the count input of the three hour counter 1550 which defines the duration of the secondary aeration.

Counter 1550, which is a type 74C193 counter connected for operation in the count up mode, counts timing pulses at the rate of 1 cycle per hour and effects disabling of gate 1545, thereby inhibiting gate 1515 at the end of a three hour interval. The 1 cycle per day timing pulses are supplied to the count up input of the counter 1550 over AND gate 1551 which is enabled when flip flop 1544 is set. Gates 1552–1553 responds to a count of three for counter 1550 to disable gate 1545.

A reset circuit 1555 includes a one shot circuit 1556, which is triggered by the negative going output of inverter 1553, provided counter 1550 reaches a count of three, and generates a reset pulse which is supplied to counter 1550 via gate 1558 and to flip flop 1544 via gate 1557. The reset signal is also provided to flip flop 1562–1565 via gate 1576, and via gates 1577 and 1578 effects loading of the five/seven day counter 1580.

For the purpose of enabling of the secondary aeration limit gate 1541 in the absence of primary aeration conditions during a five day interval following a secondary aeration, AND gate 1572 monitors the status of flip flop 1565 and the five day counter 1580 and controls the state of the flip flop 1564. The flip flop 1565 is reset by reset circuit 1555 following a secondary aeration, and enables gate 1572 to follow the state of counter 1580. Flip flop 1565 also enables a gate 1584, when it is primed by signal wet Aeration Cycle, and its output via OR gate 1582 enables gate 1581 to extend timing pulses to the five/seven day counter 1580.

Gate 1572 is enabled when the counter 1580 reaches a count of zero, and is then disabled when the counter 1580 is reloaded with a count of five, under the control of one-shot circuit 1535. When gate 1572 is disabled, its output goes low and clocks flip flop 1564 to set the flip flop. When flip flop 1564 is set, its true output Q goes high and via OR gate 1574 enables gate 1541 to follow the status of contacts 76.

DRY GRAIN AERATION OPERATION

When the aeration switch 41 (FIG. 2) is set to the "dry" position, signal Grain Aeration Cycle is generated. This signal is extended over gate 1503 to prime gate 1504 so that when primary condition sensor contacts 75 close, gate 1502 is enabled to follow the one cycle per day timing pulses. When the timing pulse goes high, gate 1502 is enabled, enabling gate 1504 which via gates 1505–1507 sets flip flop 1509. When set, the true output Q of flip flop 1509 enables gate 1512 to generate signal Enable Primary Aeration which causes gate 1515 to generate the signal Aerate for the fan control logic 32. Also, gate 1510 is enabled to gate timing pulses at the one cycle per hour rate to the count up input of the twelve hour counter 1514. The fan is thus enabled for a twelve hour aeration period defined by the counter 1514.

When counter 1514 reaches a count of twelve, the output of gate 1518 goes low and inhibits gate 1512, thereby inhibiting gate 1515 to terminate the signal Aerate. Also, one shot circuit 1517 triggered and generates a reset pulse for resetting the twelve hour counter 1514 and flip flop 1509 and for setting flip flop 1522. When flip flop 1522 is set, gate 1505 is inhibited, disabling the primary limits. Also, signal Delay Enable provided at the true output of the flip flop 1522 enables gate 1531 to gate timing pulses at the rate of one cycle per day to the seven/day wait counter 1530.

At the end of the seven-day wait period defined by counter 1530, the borrow output of counter 1530 goes low, disabling gate 1533 which via gate 1534 triggers one shot circuit 1535. The one shot circuit 1535 generates a reset pulse to reset flip flop 1522 and load the counter 1530 with a count of seven. When flip flop 1522 is reset, its false output goes high reenabling gate 1506, to reenable the primary limits. Also, the true output Q of flip flop 1522 goes low, disabling gate 1531 to prevent the passage of further timing pulses to the counter 1530.

The dry grain aeration logic is then prepared for the next aeration cycle when the primary limits are again met.

WET GRAIN AERATION OPERATION

As indicated above, a wet grain aeration cycle can be initiated either by operating the aeration switch 41 to the position "wet" or in response to the signal Wet Aeration Cycle provided by the exit from drying mode logic 38. In either case, signal Wet Aeration Cycle is generated and via gate 1503 primes gate 1504 permitting it to be enabled in response to enabling of gate 1502 when contacts 75 close indicating that the primary aeration limits are met. Also, with reference to FIG. 15A, signal Wet Aeration Cycle via inverter 1583 establishes preset controls for counter 1580 to set the counter to a count of five whenever a signal is provided at its load input.

For wet grain aeration cycles, primary twelve hour aerations are initiated as described above for dry grain aeration cycles. That is, the primary limit circuitry 1501 initiates the primary twelve hour aeration period, effecting the generation of signal Aerate via gate 1515, and the twelve hour counter 1514 defines the duration of the aeration period. However, for wet grain aeration cycles, the seven/five day counter 1580 (FIG. 15A) operates in synchronism with the seven day counter 1530 to define the five day wait period before primary aeration limits are reenabled following a primary aeration. At the end of the five day delay, the counter 1580, via gate 1533 (FIG. 15), enables one-shot circuit 1535 to reset flip flop 1522, thereby reenabling gate 1505 and thus the primary limits.

When flip flop 1509 is set at the start of a primary aeration cycle, its false output $\overline{Q}$ goes low, generating a negative going trigger pulse which triggers one shot circuit 1585 which, via gates 1577 and 1578, loads the five day counter 1540 with a count of five. During the twelve hour primary aeration, flip flop 1522 remains reset, and gate 1584 is inhibited so that gate 1581 is disabled preventing timing pulses from being extended to the counter 1580.

At the end of the twelve hour aeration cycle, one shot circuit 1517 is triggered by counter 1514, setting flip flop 1522 which via its true output Q enables gate 1531 to gate one cycle per day timing pulses to the seven day counter 1530, and via OR gate 1582 enables gate 1581 to gate timing pulses at the rate of one cycle per day to the countdown input of five day wait counter 1580. Also, when flip flop 1522 is set, its false output $\overline{Q}$ goes low inhibiting gate 1505 thereby inhibiting the primary limits.

When counter 1580 reaches a count of zero, its borrow output goes low and disables gate 1533 which via gate 1534 triggers one shot circuit 1535 enabling it to generate a reset pulse for resetting flip flops 1509 and 1522 and for loading the five day counter 1580 with a count of five. When flip flop 1522 is reset, gate 1505 is reenable, reenabling the primary limits.

Generally, primary aeration conditions will not be present immediately after the five day wait period, and normally not within the two day wait period following the five day interval. However, should the primary conditions be net at the end of the five day wait period, a further primary aeration cycle is initiated in the manner described above.

The absence of primary aeration conditions within two days of the wait period enables the secondary aeration limits. Referring to FIG. 15A, flip flop 1565 is set by the negative pulse provided when flip flop 1509 is set at the start of a primary aeration cycle. Accordingly, its true output Q goes high and primes gate 1571, and its false output $\overline{Q}$ inhibits gate 1572. Gate 1571 follows the status of the five day wait counter 1580 and is enabled when the counter counts down to zero at the end of the five day wait period. Also, when the borrow output of counter 1580 goes low, one shot circuit 1535 is triggered and generates a negative going pulse which via gate 1578 causes the reloading of the five day counter 1580 so that its borrow output goes high. When the borrow output of counter 1580 goes high, gate 1571 is disabled providing a negative going pulse at the clock input of the flip flop 1561 causing its true output Q to go high. Accordingly, gate 1567 is enabled to extend one cycle per day timing pulses to the pulse divider circuit 1566 comprised of flip flops 1562 and 1563. After two timing pulses are registered, the true output Q of flip flop 1563 goes high and via OR gate 1574 enables secondary aeration limit gate 1541 to follow the status of secondary aeration condition contacts 76.

Accordingly, when the secondary aeration condition are met, contacts 76 close enabling gate 1541 which via inverter 1542 and AND gate 1543 set flip flop 1544 to initiate a secondary aeration. When set, the true output Q of flip flop 1544 goes high and enables gate 1545 to generate signal Enable Secondary Aeration. This signal enables gate 1515 to generate signal Aerate for the fan control logic. Also, the true output Q of flip flop 1544 enables gate 1551 to extend one cycle per hour timing pulses to the count up input of the three hour counter 1550 which defines the duration of the three hour secondary aeration.

When counter 1550 counts three pulses, gates 1552–1553 inhibit gate 1545, and thus gate 1515, to terminate signal Aerate. Also, one shot circuit 1556 is triggered and generates a reset signal which via gates 1558 and 1557 clears the three hour counter 1550 and resets flip flop 1544, respectively. Also, the reset signal via gate 1576 is supplied to reset inputs of flip flops 1562–1565, and via gate 1577 and gate 1578 effects reloading of the five day counter 1580. It is pointed out that when a reset signal is applied to flip flop gate 1574 inhibits gate 1541 thereby disabling the secondary aeration limits.

It is pointed out that if primary limits are met before the end of the five day delay before secondary limits are enabled, flip flop 1509 is set and it triggers one-shot circuit 1585 which resets counter 1580 to a count of five interrupting the initial five day delay and effectively overriding the provision of a secondary aeration until after the new five day delay.

The absence of primary aeration conditions within five days of a secondary aeration enables the secondary aeration limits. That is, since flip flop 1565 is reset following a secondary aeration, gate 1572 is enabled to follow the status of the five day counter 1580 while gate 1571 is inhibited. Accordingly, if primary aeration limits are not met following the secondary aeration cycle, flip flop 1509 remains reset and thus flip flop 1565 also remains reset. During this interval, clock pulses at the rate of one cycle per day are gated to the five day counter 1580 over gate 1581 which is enabled by gates 1584 and 1582 whenever flip flop 1565 is in its reset state. At the end of the five day period, the borrow output of counter 1580 goes low, enabling gate 1572. Also, in the manner indicated above, gate 1533 (FIG. 15) is disabled causing triggering of one shot circuit 1535 which effects reloading of the five day counter 1580, causing its borrow output to go high. When the borrow output of counter 1580 goes high, gate 1572 is disabled, generating a negative going trigger pulse for flip flop 1564 which sets the flip flop and causes its true output Q to go high. This output via gate 1574 enables secondary limit gate 1541 to follow the secondary aeration limit sensor contacts 76 and effect a three hour secondary aeration whenever the secondary aeration limits are set.

The next time that the primary aeration limits are met, and if gate 1505 is enabled, flip flop 1509 is set, causing flip flop 1565 to be set thereby disabling gate 1572 to prevent initiating a further secondary aeration at the end of the five day delay following the aeration. However, the two day circuit 1566 comprises of flip flops 1562 and 1563 is reenabled and operates as described above to enable the secondary aeration limits.

EXIT FROM AERATION

Referring the FIGS. 16 and 16A, the exit from aeration logic 43 governs the exit from aeration mode of system halt when the average daily temperature is equal to or greater than 35° F., derived from the occurence of two consecutive daily temperatures of 45° or greater. A temperature monitoring circuit 1601, including NAND gate 1602 and tandem connected flip flops 1603 and 1604, monitors the status of ambient temperature sensor contacts 77 (FIG. 2) to provide a control output indicating that contacts 77 have been cycled closed twice. Gate 1601 is enabled to follow the status of contacts 77 whenever the signal Wet Aeration Cycle is true.

A timer circuit 1606, comprised of tandem connected flip flops 1607 and 1608, and gates 1609–1611, is operable when enabled to count timing pulses provided at the rate of one cycle per day and provide a control output indicating a two day interval. Gate 1609 is disabled, enabling gate 1614 to following the timing pauses when flip flop 1603 is set.

The outputs of the temperature monitoring circuit 1601 and the timer circuit 1606 are logically combined by a NAND gate 1612 which via inverter 1614 generates a signal Exit From Aeration Mode whenever the ambient temperature reaches 45° F. for two consecutive days. Gate 1612, which is normally disabled, provides signal $\overline{\text{Disable Grain}} \geqq 45°$ F. for the fan control logic 32.

A reset circuit 1615 including exclusive OR gate 1616, NOR gate 1617 and one-shot circuit 1618, generates a reset signal for application to the flip flops 1603, 1604, 1607 and 1608 whenever one of the temperature monitoring circuit 1601 and the timer circuit 1606, but not both, provides its control output. This signifies either that a temperature equal to or greater than 45° was sensed on only one of two consecutive day.

Referring to FIG. 16A, NAND gates 1621 and 1622 logically combine signal exit From Aeration Mode with respective signals Dry Aeration Cycle and Wet Aeration Cycle, generated by the Exit Drying mode logic (FIG. 14). Gate 1621 is enabled following a dry aeration cycle, and generates an output signal Clear, which effects shut down of the system. The signal clear resets a start/stop flip flop (not shown) associated with the start switch 62 and stop switch 63 (FIG. 2). Gate 1622 is enabled following a wet aeration cycle, and generates a signal Wet Aeration Cycle which inhibits gate 1403 (FIG. 14) terminating signal Wet Aeration Cycle thereby inhibiting the aeration logic (FIG. 15). Also, the signal output of gate 1622 triggers a one-shot 1623 which generates a reset signal, which gate 1624 is is OR'ed by with the Master Reset signal generated in response to operation of reset switch 61 (FIG. 2), for the controller circuit, and causing controller operation to be returned to the normal drying mode. The operator halts the drying manually when the grain is dry.

Referring to FIG. 16, signal Reset, generated when the reset pushbutton 61 is depressed, is extended via gate 1624 to the clock input of the one shot circuit 1618 via gate 1617 to effect resetting of flip flops 1603, 1604, 1607 and 1608 at the start of each drying cycle.

For purposes of illustrating the operation of the exit from aeration mode logic 43, it is assumed that a wet grain aeration preceeds the exit, so that signal Wet Aeration Cycle is true and that flip flops 1603, 1604, 1607 and 1608 are cleared so that respective true outputs are low and false outputs are high. Accordingly, gate 1609 is enabled, inhibiting gate 1611. Since signal Wet Aeration Cycle is true, gate 1602 is enabled to follow that status of contacts 77.

When the ambient temperature increases to 45°, typically in early spring, gate 1602 is enabled and its output goes low clocking flip flop 1603 so that its true output Q goes high and its false output $\overline{Q}$ goes low. When the false output Q of flip flop 1603 goes low, gate 1609 is disabled, and with the next 1 cycle/day timing pulse, gate 1611 is enabled. The output of gate 1611 goes low clocking flip flop 1607 and its true output Q goes high and its false output $\overline{Q}$ goes low to maintain gate 1609 disabled.

Generally with declining afternoon or evening temperatures, the ambient temperature will decrease below 45° F. causing contacts 77 to open disabling gate 1602, and the output of gate 1602 goes high. The next time the temperature becomes equal to or greater than 45°, contacts 77 reclosed and gate 1602 is enabled and causing flip flop 1603 to toggle so that its true output Q goes low, clocking flip flop 1604 so that its true output Q goes high. Also, the next timing toggles flip flop 1607 so that its true output Q goes low, clocking flip flop 1608 so that its true output Q goes high. Accordingly, gate 1612 is enabled and signal $\overline{\text{Disable Grain Temperature Sensors}}$ goes low. Also, signal Exit From Aeration mode is generated at the output of inverter 1614, and via gate 1622 (FIG. 16A) causes gate 1403 (FIG. 14) to be inhitibed, terminates signal Wet Aeration Cycle, and via one shot circuit 1623, generates a signal for resetting the controller circuits. The system reenters the drying mode and the operator halts drying manually when the grain is dry.

If the temperature fails to increase to 45° or greater before flip flop 1608 is set, the exclusive OR gate 1616 disables gate 1617 when flip flop 1608 is set, and triggers one shot circuit 1618 which generates a reset signal to clear the flip flops 1603, 1604, 1607 and 1608.

If contacts 77 are cycled closed, open and reclosed in the same day, then flip flop 1604 is set before flip flop 1608 and the exclusive or gate 1617 effects triggering of the one shot circuit 1618 to clear the flip flops.

LOW-TEMPERATURE DRYING EMPLOYING SOLAR HEAT

Referring to FIG. 17, there is shown a simplified representation of a low-temperature grain drying system which includes a solar heating system 24 as a primary heat source for providing supplemental heating of the air supplied to the inlet of the fan 13. The fan draws ambient air through the solar collector directly, for heating the air prior to circulating it through the grain storage bin. The solar heating system 24 may be conventional in form and accordingly will not be described in detail in this application.

An electrical resistance heater 15, located at the inlet of the fan, is provided as a backup energy source to augment the solar collector output during prolonged periods of inadequate collector output as may occur during night hours or on overcast days. Transfer from solar heating to electrical heating is effected by controller 30' of the system.

The controller 30' is generally similar to the controller 30 described above with reference to the embodiment shown in FIG. 2, but includes a heater control logic 35', shown in FIG. 10, in place of the heater control logic 35 (FIG. 13). Also, the initialization logic (Table I) is modified to reflect the predicted average output of the solar collector and provide suitable control inputs to the heater control logic 35' as will be shown. All other system control modes, including exits are the same as in the previously described system.

Referring to FIG. 18, the heater control logic 35' comprises an enabling circuit, indicated generally at 1801, and a heater control circuit, indicated generally at 1802. The enabling circuit 1801 includes a day counter 1804 which defines a delay interval before the humidistatic control logic is enabled to effect energization of the electrical heater. A differential thermostat 26 signals the presence of a specified minimum collector temperature rise as an indicator of adequate collector output. In the absence of such signal over the delay period defined by the day counter, the enabling circuit enables the heater control circuit to enable heater operation. The heater control circuit 1802, which is generally similar to the heater control logic 35 (FIG. 13) provides humidistatic control of heater operation, maintaining the heater 15 de-energized during periods when ambient relative humidity is equal to or less than 60% as signalled by a humidistatic input sensor 71.

Considering the heater control logic 1800 in more detail, with reference to the enabling circuit 1802, the day counter 1804 is a type 74C193 counter connected for a count-down operation. The counter preset inputs 1803 are connected to outputs of an initialization logic (not shown) which is similar to initialization logic 31, but also pre-programmed to provide additional outputs for the presetting the day counter 1804 to establish the appropriate delay periods for various initial conditions. These delay periods are determined using computer simulation of temperature rise requirements, the size of the back-up heater, and the estimated average collector output period. The values of delay periods for humidistatic fan control and transfer from solar to electrical heating fo exemplary sets of conditions are illustrated in Table III.

TABLE III

| | Initialization Logic Delay Periods | | | | | | | |
|---|---|---|---|---|---|---|---|---|
| | Harvest Date | | | | | | | |
| | Before Oct. 15 Harvest Moisture, % wb | | | | After Oct. 15 Harvest Moisture, % wb | | | |
| | <24 Control Function | | >24 Control Function | | <24 Control Function | | >24 Control Function | |
| Airflow Rate (cfm/bu) | C | HS | F | HS | F | H | F | H |
| <(1.5) | 2 | 2 | 4 | 1 | 2 | 1 | 3 | 1 |
| >(1.5) | 2 | 2 | 2 | 1 | 2 | 1 | 2 | 1 |

In Table III, control function C is the week counter preset for the fan control logic and represents the number of weeks of drying prior to enable humidistatic fan control, and control function HS is the day counter couner preset and represents the number of consecutive days of less than minimum solar collector temperature rise before heater is enabled.

With continued reference to FIG. 18, a one-shot circuit 1809, which is triggered in response to a reset signal supplied to the circuit 1805 through gate 1808, generates a load signal for the day counter 1804. The load signal also resets a latch circuit 1810 which by its false output $\overline{Q}$ enables and AND gate 1806 to gate timing pulses at the rate of 1 cycle per day to the count down input of the day counter. The counter 1804 is reset to the programmed time delay upon receipt of a control signal provided by the differential thermostat 26 indicating the preset temperature rise across the solar collector has been reached or exceed. The control signal via gate 1808 triggers the one shot 1809 thereby generating a load signal for the counter 1804.

In the absence of the control signal within the present number of days, the borrow output of the day counter 1804 sets the latch 1810 which by its trueoutput Q enables the heater control circuit 1802.

The heater control circuit 1802 includes three AND gates 1811, 1812, and 1813 which logically combine the enabling output of the enabling circuit 1801, signal Fan Enable and signals representing the status of the humidistatic sensor 71 and the mode control switch 41 (FIG. 2) and generate a signal which via inverter 1815 enables solid state relug 36 to effect heater energization.

OPERATION OF SOLAR HEATING CONTROL LOGIC

As indicated above, aside from the the heater control logic 35' shown in FIG. 18, the controller operation for the system of FIG. 17 is similar to that for controller 30 shown in FIG. 2, and the system control modes including exits, are the same as in the system described hereinabove. The initial conditions of harvest date, harvest moisture and air flow rate supplied to the controller 30 by way of the appropriate dials (such as dials 37–39, FIG. 2) cause the intialization logic 31' to provide appropriate control outputs. For example, for harvest date prior to October 15, harvest moisture less than 24 percent wb., and air flow rate less than 1.5 cfm/bu, the weeks delay counter 1108 of the fan control logic 32 (FIG. 11) is set to delay humidistatic fan control for a two week period following start up, and the day counter 1804 is loaded with a count representing two days. Also, it is assumed that the aeration mode switch 41 (FIG. 2) is set to indicate a dry aeration cycle.

The day counter 1804 is loaded automatically with the programmed time delay period in response to a reset signal which triggers the one shot 1809 generating a load signal for the day counter 1804. The load signal also causes the latch circuit 1810 to be reset so that its false output $\overline{Q}$ enables gate 1806 to pass the one cycle per day timing pulses to the count down input of the counter. The latch 1810 also inhibits gate 1811 thereby maintaining the heater control circuit 1802 disabled.

During the drying cycle, the heater control logic 1802 is maintained disabled, keeping the electrical heater off as long as the solar heater is providing sufficient output. The day counter is reset to the predetermined count each time a control signal is provided by the differential thermostat 26 indicating that the preset temperature rise, typically 4.4 degrees F., across the solar collector has been reached or exceeded. This control signal via gate 1808 triggers the one shot 1809 causing the preset count of two to be loaded into the day counter.

Should the control signal fail to be provided before the end of the two day interval, indicative of lack of sufficient heat available from the solar collector, then the borrow output of the counter goes high and sets latch 1810. This causes its false output $\overline{Q}$ to go low, inhibiting gate 1806 and causing its true output Q to go high, enabling gate 1811 to follow the output of the humidistatic sensor. Accordingly, whenever the relative humidity is above 60%, gate 1811 is enabled.

Since the aeration mode switch is set to indicate a dry aeration cycle, gate 1812 is enabled, permitting gate 1813 to follow signal Fan Enable which is generated by the the fan control logic 32 to turn on the fan. When enabled, gate 1813 enables the heater relay, via solid state switch 36, to energize the electrical heater. The electrical heater is operated under humidistatic control until the occurrence or the next control signal provided by the differential thermostat 26 which causes reset of the day counter and of latch 1810, inhibiting the heater control circuit 1802.

When the heater control circuit is enabled by the enabling circuit 1801, the sequence is overridden at any time by the ambient relative humidity becoming equal to or less than 60% which results in inhibiting of gate 1811, causing gates 1812 and 1813 to be inhibited. Also, if the mode control switch is operated to off position or to the wet aeration position, gate 1812 is inhibited and maintains gate 1813 disabled preventing heater operation. When the fan is turned off by the fan control logic, gate 1913 is inhibited de-energizing the heater.

At the end of the drying cycle, the system automatically exits to the aeration mode as described above, and grain conditioning is completed in the manner described above for the system of FIG. 1.

Having thus disclosed in detail preferred embodiments of my invention, persons skilled in the art will be able to modify certain of the structures which has been disclosed and to substitute equivalent elements for those which have been illustrated; and it is, therefore, intended that all such modifications and substitutions be covered as they are embraced within the spirit and scope of the appended claims.

APPENDIX I

TABLE II

APPENDIX I

| Harvest date | Harvest moisture (% w.b.) | Temp., rise (°F.) | Min. airflow[a], weeks to dry[b], and drying season[c] | |
|---|---|---|---|---|
| Oct. 15 | 22 | 2 | 0.36[a]31[b]69[c] | 0.81 92 62 |
| | | | 0.41 29 67 | 1.02 30 61 |
| | | | 0.52 30 66 | 1.27 26 65 |
| | | | 0.53 33 60 | 1.32 08 64 |
| | | | 0.78 31 68 | 1.64 06 63 |
| Oct. 15 | 24 | 2 | 0.69 25 69 | 1.41 11 68 |
| | | | 0.79 26 67 | 1.72 08 64 |
| | | | 1.00 26 66 | 2.06 07 65 |
| | | | 1.01 11 60 | 2.18 28 61 |
| | | | 1.17 10 62 | 4.42 04 63 |
| Oct. 15 | 24 | 5 | 0.79 23 69 | 1.26 10 68 |
| | | | 0.84 24 67 | 1.67 06 64 |
| | | | 0.89 10 66 | 1.85 27 61 |
| | | | 1.01 10 60 | 2.25 05 65 |
| | | | 1.24 09 62 | 4.18 04 63 |
| Oct. 15 | 26 | 2 | 1.40 23 67 | 2.69 07 64 |
| | | | 1.43 24 66 | 2.77 10 68 |

TABLE II-continued

APPENDIX I

| Harvest date | Harvest moisture (% w.b.) | Temp., rise (°F.) | Min. airflow[a], weeks to dry[b], and drying season[c] | |
|---|---|---|---|---|
| | | | 1.50 09 69 | 3.35 27 61 |
| | | | 1.68 08 60 | 4.89 04 65 |
| | | | 2.34 60 62 | 6.96 04 83 |
| Oct. 15 | 26 | 5 | 1.36 07 66 | 2.37 04 64 |
| | | | 1.42 06 67 | 2.45 04 61 |
| | | | 1.62 06 69 | 2.46 04 68 |
| | | | 1.67 05 60 | 4.05 02 65 |
| | | | 2.18 04 62 | 4.90 03 63 |
| Nov. 1 | 22 | 2 | 0.40 28 69 | 0.61 08 66 |
| | | | 0.45 08 67 | 0.63 27 68 |
| | | | 0.56 28 60 | 0.72 27 61 |
| | | | 0.59 27 62 | 0.92 27 63 |
| | | | 0.70 27 65 | 1.25 27 64 |
| Nov. 1 | 24 | 2 | 0.54 27 69 | 0.88 26 66 |
| | | | 0.67 26 67 | 0.89 28 62 |
| | | | 0.69 31 68 | 1.04 30 61 |
| | | | 0.71 31 60 | 1.08 27 65 |
| | | | 0.75 28 63 | 3.51 07 64 |
| Nov. 1 | 24 | 5 | 0.56 26 69 | 0.84 21 66 |
| | | | 0.63 29 68 | 0.86 27 62 |
| | | | 0.65 24 60 | 0.88 29 61 |
| | | | 0.72 25 67 | 1.10 24 65 |
| | | | 0.78 21 63 | 2.48 08 64 |
| Nov. 1 | 26 | 2 | 0.93 17 69 | 1.84 20 66 |
| | | | 1.17 25 68 | 1.86 22 62 |
| | | | 1.21 20 67 | 2.13 22 65 |
| | | | 1.50 25 60 | 2.24 24 61 |
| | | | 1.68 20 63 | 5.30 03 64 |
| Nov. 1 | 26 | 5 | 0.93 17 69 | 1.65 07 63 |
| | | | 0.94 23 68 | 1.69 18 66 |
| | | | 1.18 18 67 | 1.78 06 65 |
| | | | 1.29 08 60 | 1.83 23 61 |
| | | | 1.60 22 62 | 3.66 03 64 |

I claim:

1. In a low-temperature grain conditioning system including a grain storage bin, and a fan operable to draw air into the storage bin and force the air through the grain, a controller for controlling the operation of the fan, said controller comprising: initializing means including initialization circuit means responsive to a set of input signals representing initial conditions to provide a plurality of control outputs, dry down indicating means responsive to a first one of said control outputs to indicate an unsuccessful drying operation whenever the set of input signals corresponds to initial conditions for which the probability of successful drying of the grain is less than a preselected value, and to indicate when completion of drying of the grain can be expected whenever the set of input signals corresponds to initial conditions for which the probability of successful drying of the grain is equal to or greater than said preselected value; fan control means including fan enable circuit means normally operable to effect continuous operation of said fan, said fan control means including condition responsive circuit means enabled by a second one of said control outputs to respond to condition sensing means and generate a signal for disabling said fan enable circuit means to interrupt the operation of said fan whenever a predetermined condition is sensed; and aeration circuit means operable when enabled to control said fan enable circuit means to provide intermittent operation of the fan, said condition responsive circuit means being ineffective in disabling said fan enable circuit means when it is operating under the control of said aeration circuit means.

2. A system as set forth in claim 1 wherein said initializing means includes first, second and third selector switches individually settable to a plurality of different positions to indicate values of initial conditions including the harvest date of the grain, the harvest moisture of the grain, and the rate of air flow through the storage bin, and circuit means for providing a set of input signals for the initialization circuit means indicative of the settings of said selector switches.

3. A system as set forth in claim 1 wherein said initialization circuit means is preprogrammed on the basis of long-term computer simulation of the low-temperature grain conditioning process to respond to different sets of input signals, representing correspondingly different sets of initial conditions to provide different control outputs.

4. A system as set forth in claim 3 wherein said initialization circuit means includes memory means having a plurality of addressable storage locations, different ones of said storage locations storing a different multibit control word corresponding to different sets of initial conditions, and memory address means responsive to a given set of input signals for controlling said memory means to effect readout of the control word stored at a storage location corresponding to the set of initial conditions represented by the set of input signals.

5. A system as set forth in claim 1 wherein said condition responsive circuit means of said fan control means includes timing means responsive to said second control output to define a predetermined interval of time, and inhibit means enabled by said timimg means at the end of said time interval to respond to said condition sensing means and disable said fan enable circuit means whenever said predetermined condition is sensed.

6. A system as set forth in claim 1 which includes heater means for heating the air supplied to said storage bin, and heater control means operable when enabled to effect energization of said heater means, said initialization circuit means providing a third control output for enabling said heater control means as a function of the set of input signals supplied to said initialization circuit means.

7. In a low-temperature grain conditioning system including a grain storage bin, and a fan operable to draw air into the storage bin and force the air through the grain, a controller for controlling the operation of the fan, said controller comprising: initializing means including initialization circuit means responsive to a set of input signals representing initial conditions to provide a plurality of control outputs, dry down indicating means responsive to a first one of said control outputs to provide an indication of the probability of success of drying the grain; mode select means for enabling said controller to initially be operable in a drying mode and to thereafter be operable in an aeration mode; fan control means responsive to a second one of said control outputs and to first condition sensing means when said controller is operable in the drying mode to maintain the fan operating continuously in the absence of a predetermined condition and to disable the fan whenever said predetermined condition is sensed by said first condition sensing means; and aeration means including timing means for defining timing intervals of at least first and second durations, and aeration circuit means enabled by said mode select means to respond to second condition sensing means for controlling said fan control means while the controller is operating in aeration mode whereby the fan is operated continuously during an aeration period of said first duration whenever preselected ambient conditions are sensed by said second condition sensing means and the operation of the fan is prevented for a period of at least said second duration following each aeration period.

8. A system as set forth in claim 7 which includes heater means operable to heat the air supplied to the storage bin and heater control means enabled in response to a third one of said control outputs to effect energization of said heater means when said controller is operable in the drying mode, said heater control means being maintained disabled, preventing operation of said heater means in the absence of said third control output.

9. A system as set forth in claim 8 wherein said heater control means is disabled in response to an output provided by third condition sensing means to interrupt operation of said heater means when a predetermined condition is sensed.

10. A system as set forth in claim 9 wherein said third condition sensing means comprises a humidistat which responds to ambient relative humidity of a predetermined value to effect interruption of the operation of said heater means.

11. A system as set forth in claim 7 which further comprises heater means including a solar heating system for heating air supplied to an inlet of said fan.

12. A system as set forth in claim 11 wherein said heater means further comprises an electrical resistance heater, heater control circuit means for controlling the energization of said resistance heater, and enabling circuit means for controlling the enabling of said heater control circuit means as a function of the occurrence of a minimum temperature rise of a collector of the solar heating system.

13. In a low-temperature grain conditioning system including a grain storage bin, and a fan operable to draw air into the storage bin and force the air through the grain, a controller for controlling the operation of the fan, said controller comprising: initializing means including initialization circuit means responsive to a set of input signals representing initial conditions to provide a plurality of control outputs, dry down indicating means responsive to a first one of said control outputs to provide an indication of the probability of success of drying the grain; mode select means for enabling said controller to initially be operable in a drying mode and to thereafter be operable in an aeration mode; fan control means responsive to a second one of said control outputs and to first condition sensing means to enable intermittent operation of the fan when said controller is operable in the drying mode; heater means including a solar heating system for heating air supplied to an inlet of said fan, and aeration means enabled by said mode select means to respond to second condition sensing means for controlling said fan control means to provide intermittent operation of the fan while the controller is operating in the aeration mode; said heater means further including an electrical resistance heater energizable to provide supplemental heating of the air supplied to said fan inlet, heater control circuit means for controlling the energization of said resistance heater, and enabling circuit means including timing means for defining a time interval and for generating a signal for enabling said heater control circuit means to energize said resistance heater, and inhibit circuit means enabled in response to an output of a differential temperature sensor, indicative of the presence of a minimum collector temperature rise to prevent said timing means from generating its enabling signal thereby preventing the energization of said resistance heater.

14. A system as set forth in claim 12 wherein said heater control means includes gating means responsive to a control output of a humidity sensor to prevent the energization of said electrical heater whenever the relative humidity sensed is less than a selected set point value.

15. In a low-temperature grain conditioning system including a grain storage bin, and a fan operable to draw air into the storage bin and force the air through the grain, a controller for controlling the operation of the fan, said controlling comprising: initializing means including initialization circuit means responsive to a set of input signals representing initial conditions to provide a plurality of control outputs; dry down indicating means responsive to a first one of said control outputs or provide an indication of the probability of success of drying the grain; mode select means for enabling said controller to initially be operable in a drying mode and to thereafter be operable in an aeration mode; fan control means including fan enable means normally enabled to effect continuous operation of the fan while the controller is operating in the drying mode, condition responsive circuit means including inhibit means responsive to said first condition sensing means to disable said fan enable means whereby providing intermittent operation of the fann as a function of the condition sensed by said first condition sensing means, and timing means responsive to said second control output to define a predetermined time interval and to prevent said inhibit means from responding to said first condition sensing means during said time interval thereby providing continuous operation of the fan during said time interval; and aeration means enabled by said mode select means to respond to second condition sensing means for controlling said fan enable means to provide intermittent operation of the fan while the controller is operating in the aeration mode.

16. A system as set forth in claim 15 wherein said first condition sensing means comprises a humidistat which responds to ambient relative humidity of a predetermined value to generate an inhibit signal to cause said inhibit means to disable said fan enable means.

17. A system as set forth in claim 15 wherein said condition responsive circuit means includes second timing means enabled by said first-mentioned timing means at the end of said time interval to respond to said inhibit signal and to permit disabling of said fan enable means only when said inhibit signal is provided for a preselected time interval.

18. In a low-temperature grain conditioning system including a grain storage bin, and a fan operable to draw air into the storage bin and force the air through the grain, a controller for controlling the operation of the fan, said controller comprising: mode select means for enabling the controller to be operable initially in a drying mode and thereafter in an aeration mode; fan control means including fan enable circuit means operable when enabled to normally effect continuous operation of the fan when the controller is operating in the drying mode; and aeration means for controlling said fan enable circuit means to provide intermittent operation of the fan when the controller is operating in the aeration mode, said aeration means including aeration circuit means enabled by said mode select means to respond to a control output provided by a condition sensing means when ambient conditions within first limits are sensed by said condition sensing means and cause the fan to operate, timing means responsive to said aeration circuit means for maintaining the fan operating for a first period of time after said aeration circuit means responds to said control output, and inhibit means responsive to said timing means to prevent said aeration circuit means from responding to said condition sensing means for a second period of time following said first period of time.

19. A system as set forth in claim 18 wherein said fan control means further includes condition responsive means for normally enabling said fan enable circuit means, said condition responsive means being responsive to a further condition sensing means sensing a predetermined condition to disable said fan enable circuit means.

20. A system as set forth in claim 18 wherein said mode selector switch manually operable to effect the transfer of the controller operation from the drying mode to the aeration mode, said selector switch being settable to a first position to select a dry grain aeration cycle for grain which is dried while the controller is operating in the drying mode, and being settable to a second position to select a wet grain aeration cycle when the grain is only partially dried while the controller is operating in the drying mode.

21. A system as set forth in claim 20 wherein said aeration circuit means is enabled when said selector switch is set to either one of said positions.

22. A system as set forth in claim 20 wherein said aeration means further includes secondary aeration circuit means enabled by said first-mentioned aeration circuit means, in the absence of said preselected ambient conditions with a given time following said second period of time, to respond to further condition sensing means for enabling said fan enable circuit means to effect operation of the fan for a time interval, less than said first period of time, when ambient conditions within second limits are sensed by said further condition sensing means.

23. A system as set forth in claim 22 wherein said aeration means includes means for maintaining said secondary aeration circuit means disabled whenever said selector switch is set to said first position.

24. In a low-temperature grain conditioning system including a grain storage bin, and a fan operable to draw air into the storage bin and force the air through the grain, a controller for controlling the operation of the fan, said controller comprising: mode select means for enabling the controller to be operable in drying and aeration modes; fan control means including fan enable means operable when enabled to effect continuous operation of the fan when the controller is operating in the drying mode; and aeration means operable when enabled to respond to condition sensing means for controlling said fan enable means to provide intermittent operation of the fan when the controller is operating in the aeration mode, said condition sensing means including first sensor means for providing a first control output when a first condition is sensed, and second sensor means for providing a second control output when a second condition is sensed, said aeration means including primary aeration circuit means operable when enabled to respond to said first control output to enable said fan enable means to effect operation of the fan for a time interval of a given duration, thereby effecting a primary aeration, and secondary aeration circuit means controlled by said primary aeration circuit means to respond to said second control output for enabling said fan enable means to effect operation of the fan for a time interval of a duration less than said given duration, thereby effecting a secondary aeration and timing means for preventing said primary aeration circuit means from responding to said first control output for a predetermined time following a primary aeration.

25. A system as set forth in claim 24 wherein said aeration means includes control circuit means operable when enabled to respond to said timing means to enable said secondary aeration circuit means whenever said first control output fails to be provided within a predetermined time following a primary aeration.

26. A system as set forth in claim 25 wherein said control means includes delay means responsive to said timing means to delay the enabling of said secondary aeration circuit means for an interval of time after said predetermined time following a primary aeration.

27. A system as set forth in claim 26 wherein said control means includes means responsive to said timing means for enabling said secondary aeration circuit means to respond to said second control output after said predetermined time following a secondary aeration.

28. A system as set forth in claim 27 wherein said mode select means includes exit drying mode circuit means responsive to a predetermined condition to enable said primary aeration circuit means.

29. A system as set forth in claim 20 wherein said mode select means includes exit aeration circuit means responsive to a predetermined condition and to said selector switch to effect shutdown of the controller whenever a dry grain aeration cycle preceeded the exit, and to transfer controller operation from the aeration mode to the drying mode whenever a wet grain aeration cycle preceeded the exit.

30. A method for conditioning grain stored in a grain storage bin, comprising the steps of:

enabling a fan to operate continuously from the start of a drying operation until the end of a time interval defined by a timer to cause air to flow through the grain for extracting moisture from the grain;

sensing ambient relative humidity by way of a humidistat;

after said time interval, enabling the humidistat to maintain the fan operating whenever the ambient relative humidity is less than a preset value and to cause fan operation to be halted whenever ambient relative humidity is greater than said preset value;

causing the operation of the fan to be halted when the grain moisture content reaches a given value;

thereafter, sensing for predetermined ambient temperature and relative humidity conditions by way of condition sensing means;

enabling the condition sensing means to cause the fan to be operated for a predetermined duration of time whenever the predetermined conditions are sensed; and causing the fan operation to be halted after the predetermined interval and preventing the condition sensing means from causing fan to be operated for a further predetermined duration of time.

31. A method as set forth in claim 30 including the further steps of enabling a heater to operate continuously from the start of the drying operation until the grain moisture content reaches said given value;

sensing ambient relative humidity by way of a further humidistat; and enabling the further humidistat to maintain the heater operating whenever the ambient relative humidity is greater than a preset value and to cause the heater operation to be halted whenever ambient relative humidity is less than set preset value.

32. A method as set forth in claim 31 including the further step of causing the operation of the heater to be halted whenever the operation of the fan is halted.

33. A method as set forth in claim 30 including the further steps of using a solar heat source to heat the air supplied to an inlet of the fan, and sensing a given minimum solar collector temperature rise; and energizing an electrically resistance heater for heating the air whenever said given minimum solar collector temperature rise fails to be sensed within a given time period.

34. A method as set forth in claim 33 including the further steps of sensing ambient relative humidity by way of a further humidistat; and enabling the further humidistat to prevent the operation of the electrical resistance heater whenever ambient relative humidity is less than a set point value.

35. A method as set forth in claim 34 including the further step of causing the operation of the electrical resistance heater to be halted whenever the operation of the fan is halted.

36. A method for conditioning grain stored in a storage bin comprising the steps of:

sensing ambient temperature and relative humidity by way of condition sensing means;

enabling an aeration circuit means to respond to a first control output provided by the condition sensing means when preselected conditions are sensed to cause a fan to operate to cause air to flow through the grain to effect a primary aeration;

causing the operation of the fan to be halted after a first time interval defined by a first timer;

preventing said aeration circuit means from responding to said first control output for a second time interval defined by a second timer;

and enabling said aeration circuit means to respond to said first control output after said second time interval.

37. A method as set forth in claim 36 including the further steps of sensing ambient temperature by way of second condition sensing means;

enabling a second aeration circuit means to respond to a second control output provided by said second condition sensing means and to cause operation of the fan to effect a secondary aeration whenever the first mentioned control output fails to be provided within a predetermined time following a primary aeration; and causing the operation of the fan to be halted after a time interval defined by a third timer.

38. A method as set forth in claim 37 including the further step of preventing the secondary aeration circuit means from responding to said second control output for a predetermined time after a primary aeration.

39. A method as set forth in claim 37 which includes the further step of preventing the secondary aeration circuit means from responding to said second control output for a predetermined time following a secondary aeration.

40. A method as set forth in claim 36 which includes the steps of sensing grain temperature by way of a further condition sensing means; and enabling a fan control circuit means to respond to a control output provided by said further condition sensing means and effect continuous operation of the fan as long as said further condition sensing means provides its control output.

41. In a low-temperature grain conditioning system including a grain storage bin, and a fan operable to draw air into the storage bin and force the air through the grain, a controller for controlling the operation of the fan, said controller comprising:

input means for receiving signals representing initial conditions including the grain harvest date, the initial moisture content of the grain, and the air flow rate, and signals representing sensed conditions including grain temperature, ambient temperature and ambient relative humidity, signal processing means responsive to the received signals for defining a drying cycle and an aeration cycle and for using the received signals to generate control outputs based upon predicted grain moisture levels for controlling the operation of the fan during the drying and aeration cycles whereby during the drying cycle, the fan is initially operated continuously for a time indicated by at least one of said control outputs and is thereafter operated intermittently as a function of the presence or absence of a sensed ambient condition as indicated by one of said received signals, and during the aeration cycle, the fan is maintained disabled in the absence of preselected conditions as indicated by at least one other one of said received signals, and is operated whenever said preselected ambient conditions are sensed.

42. A system as set forth in claim 41 which further comprises dry down indicating means responsive to a further one of said control outputs to provide an indication of the probability of success of drying the grain.

43. A system as set forth in claim 18 wherein said mode select means comprises exit drying mode circuit means controlled by a temperature sensing means to transfer the operation of the controller from the drying mode to the aeration mode when the temperature of the grain decreases to a given value.

* * * * *

UNITED STATES PATENT AND TRADEMARK OFFICE

CERTIFICATE OF CORRECTION

PATENT NO. : 4,253,244

DATED : March 3, 1981

INVENTOR(S) : Glenn A. Kranzler

It is certified that error appears in the above—identified patent and that said Letters Patent is hereby corrected as shown below:

Column 35, line 29, "timimg" should be -- timing --.

Column 37, line 28, "fann" should be -- fan --.

Column 38, line 17, after "mode" insert -- select means includes a --.

Column 38, line 33, "with" should be -- within --.

Signed and Sealed this

Second Day of June 1981

[SEAL]

Attest:

RENE D. TEGTMEYER

Attesting Officer

Acting Commissioner of Patents and Trademarks